US011092100B2

(12) United States Patent
Aoki

(10) Patent No.: US 11,092,100 B2
(45) Date of Patent: Aug. 17, 2021

(54) CONTROL SYSTEM OF INTERNAL COMBUSTION ENGINE

(71) Applicant: TOYOTA JIDOSHA KABUSHIKI KAISHA, Toyota (JP)

(72) Inventor: Keiichiro Aoki, Sunto-gun (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 84 days.

(21) Appl. No.: 16/733,289

(22) Filed: Jan. 3, 2020

(65) Prior Publication Data

US 2020/0232407 A1 Jul. 23, 2020

(30) Foreign Application Priority Data

Jan. 23, 2019 (JP) ..... JP2019-009564

(51) Int. Cl.
*F02D 41/14* (2006.01)
*F01N 11/00* (2006.01)

(52) U.S. Cl.
CPC ..... *F02D 41/1473* (2013.01); *F01N 11/007* (2013.01); *F02D 41/1439* (2013.01); *F02D 41/1496* (2013.01)

(58) Field of Classification Search
CPC ..... F02D 41/1473; F02D 41/1439; F02D 41/1496; F02D 41/2438; F02D 41/2474; F02D 2041/2051; F02D 2041/2058; F02D 41/1454; F02D 41/123; F02D 41/1475; F02D 41/1408; F02D 41/20; F02D 41/0295; F02D 41/04; F02D 41/1484; F01N 11/007
See application file for complete search history.

(56) References Cited

U.S. PATENT DOCUMENTS 5,323,635 A 6/1994 Ueno et al.
5,777,204 A * 7/1998 Abe ..... F02D 41/068 123/694
(Continued)

FOREIGN PATENT DOCUMENTS

DE 43 17 942 A1 12/1993
EP 2 952 715 A1 12/2015
(Continued)

*Primary Examiner* — Joseph J Dallo
(74) *Attorney, Agent, or Firm* — Oblon, McClelland, Maier & Neustadt, L.L.P.

(57) ABSTRACT

A control system of an internal combustion engine comprises an air-fuel ratio sensor 40, 41 detecting an air-fuel ratio of exhaust gas, a current detecting device 61 detecting an output current of the air-fuel ratio sensor, a voltage applying device 60 applying voltage to the air-fuel ratio sensor, and a voltage control part 81 configured to control voltage applied to the air-fuel ratio sensor through the voltage applying device. The voltage control part is configured to set the applied voltage to a reference voltage determined so that the output current becomes zero when an air-fuel ratio of inflowing exhaust gas flowing into the air-fuel ratio sensor is a stoichiometric air-fuel ratio, and correct the reference voltage so that the output current detected by the current detecting device becomes zero when it is judged that the air-fuel ratio of the inflowing exhaust gas is the stoichiometric air-fuel ratio.

7 Claims, 16 Drawing Sheets

(56) References Cited

U.S. PATENT DOCUMENTS

| | | | | |
|---|---|---|---|---|
| 5,834,624 | A * | 11/1998 | Nakagawa | F02D 41/1496 73/23.32 |
| 5,925,088 | A * | 7/1999 | Nasu | G01N 27/4065 701/103 |
| 2005/0156580 | A1* | 7/2005 | Hashimoto | H03M 1/1028 323/234 |
| 2007/0045112 | A1* | 3/2007 | Tashiro | F02D 41/123 204/401 |
| 2015/0330323 | A1* | 11/2015 | Aoki | F02D 41/123 60/285 |
| 2016/0069242 | A1* | 3/2016 | Miyamoto | F01N 11/00 60/277 |
| 2017/0002760 | A1* | 1/2017 | Hayashita | F02D 41/065 |
| 2017/0248095 | A1 | 8/2017 | Okazaki | |
| 2017/0256102 | A1* | 9/2017 | Bell | G07C 5/08 |

FOREIGN PATENT DOCUMENTS

| | | | |
|---|---|---|---|
| EP | 3 020 949 | A1 | 5/2016 |
| JP | 2016-031041 | A | 3/2016 |

* cited by examiner

CONTROL SYSTEM OF INTERNAL COMBUSTION ENGINE

FIELD

The present invention relates to a control system of an internal combustion engine.

BACKGROUND

In the past, it has been known to arrange a catalyst and air-fuel ratio sensor in an exhaust passage of an internal combustion engine. By controlling an air-fuel ratio of an air-fuel mixture based on an output of the air-fuel ratio sensor, the exhaust gas is effectively purified at the catalyst and in turn the exhaust emissions are improved.

However, aging, individual variations, etc., sometimes cause deviation in the output of the air-fuel ratio sensor. For this reason, in a control system of an internal combustion engine described in PTL 1, the output of a downstream side air-fuel ratio sensor arranged at a downstream side of the catalyst is corrected. Specifically, an output air-fuel ratio of the downstream side air-fuel ratio sensor 41 is corrected based on a difference between the output air-fuel ratio of the downstream side air-fuel ratio sensor detected at a timing where the air-fuel ratio of exhaust gas flowing into the downstream side air-fuel ratio sensor becomes the stoichiometric air-fuel ratio due to rich control after fuel cut control and the stoichiometric air-fuel ratio.

CITATIONS LIST

Patent Literature

[PTL 1] Japanese Unexamined Patent Publication No. 2016-031041

SUMMARY

Technical Problem

In the above downstream side air-fuel ratio sensor, at the initial setting, the applied voltage is set so that the output current when the air-fuel ratio of the exhaust gas flowing into the downstream side air-fuel ratio sensor is the stoichiometric air-fuel ratio becomes zero. When the output current is zero, current does not flow to the air-fuel ratio sensor, therefore variation in output current due to the fluctuation of the temperature or pressure of the exhaust gas, circuit error, etc., is reduced.

On the other hand, if deviation in the output of the downstream side air-fuel ratio sensor occurs, the output current when the air-fuel ratio of the exhaust gas flowing into the downstream side air-fuel ratio sensor is the stoichiometric air-fuel ratio becomes a value other than zero. For this reason, even if the air-fuel ratio of the exhaust gas flowing into the downstream side air-fuel ratio sensor is the stoichiometric air-fuel ratio, the variation in the output current at this time becomes larger.

In the above method of correction, the deviation in output of the downstream side air-fuel ratio sensor is corrected by processing, therefore the characteristics of the downstream side air-fuel ratio sensor remain off from the initial settings. For this reason, variation in the output current of the downstream side air-fuel ratio sensor is liable to cause the precision of detection of the air-fuel ratio to fall.

Therefore, in consideration of the above problem, an object of the present invention is to provide a control system of an internal combustion engine able to keep the precision of detection of the air-fuel ratio by the air-fuel ratio sensor arranged in an exhaust passage of the internal combustion engine from falling.

Solution to Problem

The summary of the present disclosure is as follows.

(1) A control system of an internal combustion engine comprising: an air-fuel ratio sensor arranged in an exhaust passage of the internal combustion engine and detecting an air-fuel ratio of exhaust gas, a current detecting device detecting an output current of the air-fuel ratio sensor, a voltage applying device applying voltage to the air-fuel ratio sensor, and a voltage control part configured to control voltage applied to the air-fuel ratio sensor through the voltage applying device, wherein the voltage control part is configured to set the applied voltage to a reference voltage determined so that the output current becomes zero when an air-fuel ratio of inflowing exhaust gas flowing into the air-fuel ratio sensor is a stoichiometric air-fuel ratio, and correct the reference voltage so that the output current detected by the current detecting device becomes zero when it is judged that the air-fuel ratio of the inflowing exhaust gas is the stoichiometric air-fuel ratio.

(2) The control system of an internal combustion engine described in above (1), wherein a catalyst able to store oxygen is arranged in the exhaust passage, and the air-fuel ratio sensor is arranged at a downstream side of the catalyst.

(3) The control system of an internal combustion engine described in above (2), further comprising an air-fuel ratio control part configured to control an air-fuel ratio of an air-fuel mixture supplied to combustion chambers of the internal combustion engine, wherein the air-fuel ratio control part is configured to control the air-fuel ratio of the air-fuel mixture so that an oxygen storage amount of the catalyst changes between zero and a maximum oxygen storage amount, and the voltage control part is configured to correct the reference voltage so that the output current detected by the current detecting device becomes zero when an amount of change per predetermined time of the output current is equal to or less than a predetermined value.

(4) The control system of an internal combustion engine described in above (3), wherein the air-fuel ratio control part is configured to perform fuel cut control stopping supply of fuel to the combustion chambers and after the fuel cut control perform rich control making the air-fuel ratio of the air-fuel mixture an air-fuel ratio richer than a stoichiometric air-fuel ratio so that the oxygen storage amount of the catalyst becomes zero, and the voltage control part is configured to correct the reference voltage so that the output current detected by the current detecting device becomes zero when the rich control is performed and the amount of change per predetermined time of the output current is equal to or less than the predetermined value.

(5) The control system of an internal combustion engine described in above (3), wherein the air-fuel ratio control part is configured to perform active control switching the air-fuel ratio of the air-fuel mixture between an air-fuel ratio richer than the stoichiometric air-fuel ratio and an air-fuel ratio leaner than the stoichiometric air-fuel ratio so that the oxygen storage amount of the catalyst changes between zero and the maximum oxygen storage amount, and the voltage control part is configured to correct the reference voltage so that the output current detected by the current detecting device becomes zero when the active control is performed and the amount of change per predetermined time of the output current is equal to or less than the predetermined value.

(6) The control system of an internal combustion engine described in any one of above (1) to (5), wherein the voltage control part is configured to switch the applied voltage between the reference voltage and a switching voltage different from the reference voltage and, when correcting the reference voltage, correct the switching voltage so that a difference between an oxygen concentration on an exhaust side electrode of the air-fuel ratio sensor corresponding to the reference voltage when the output current is zero and the oxygen concentration on the exhaust side electrode of the air-fuel ratio sensor corresponding to the switching voltage when the output current is zero becomes constant.

Advantageous Effects of Invention

According to the present invention, there is provided a control system of an internal combustion engine able to keep the precision of detection of the air-fuel ratio by the air-fuel ratio sensor arranged in an exhaust passage of the internal combustion engine from falling.

DESCRIPTION OF EMBODIMENTS

Figure 1:
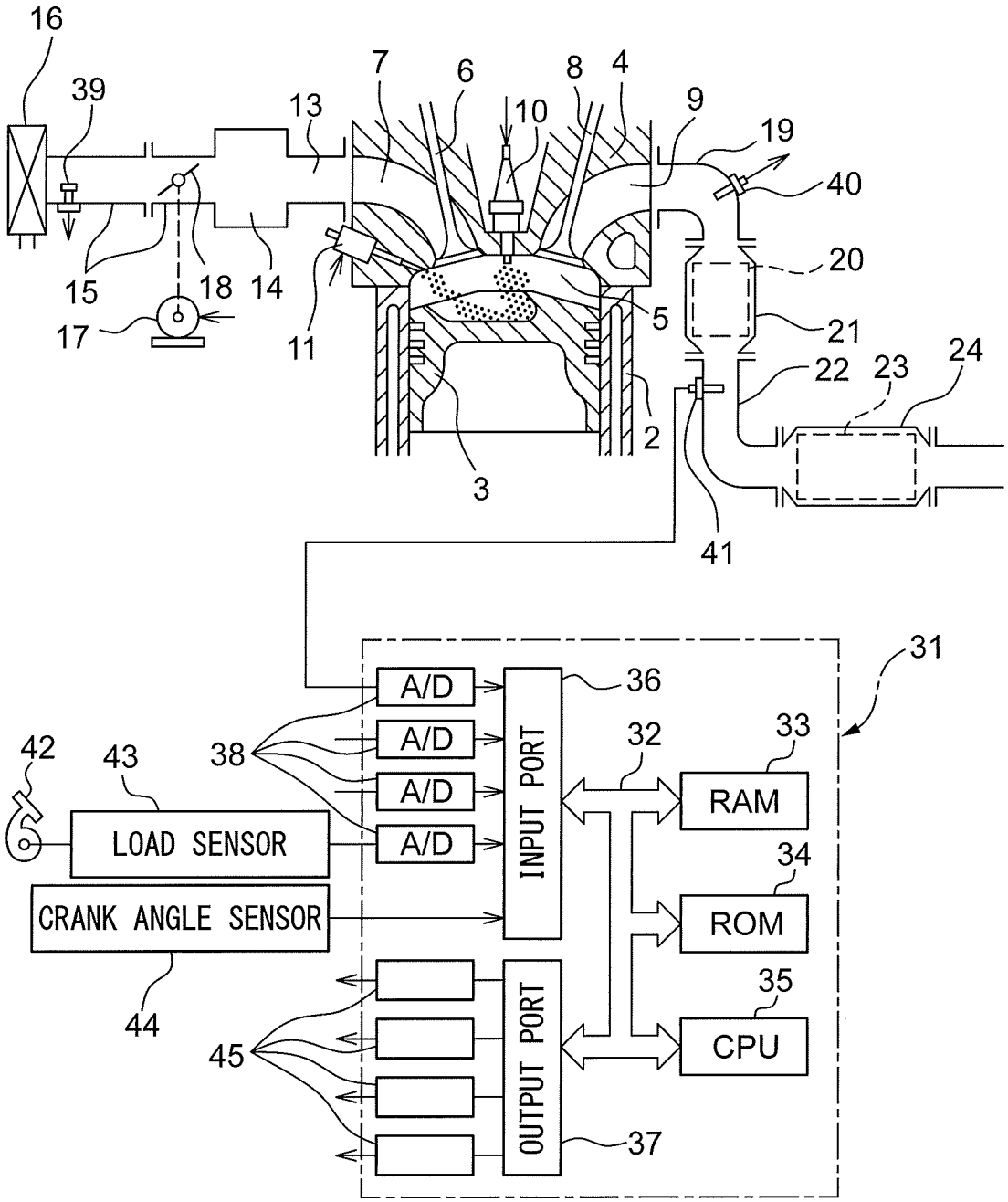
FIG. 1 is a view schematically showing an internal combustion engine to which a control system of an internal combustion engine according to a first embodiment of the present invention is provided.

Below, referring to the figures, embodiments of the present invention will be explained in detail. Note that, in the following explanation, similar components are assigned the same reference numerals.

First Embodiment

First, referring to FIG. 1 to FIG. 13, a first embodiment of the present invention will be explained.

<Explanation of Internal Combustion Engine Overall>

FIG. 1 is a view schematically showing an internal combustion engine provided with a control system of an internal combustion engine according to a first embodiment of the present invention. The internal combustion engine shown in FIG. 1 is a spark ignition type internal combustion engine. The internal combustion engine is mounted in a vehicle.

Referring to FIG. 1, 2 indicates a cylinder block, 3 a piston which reciprocates inside the cylinder block 2, 4 a cylinder head which is fastened to the cylinder block 2, 5 a combustion chamber which is formed between the piston 3 and the cylinder head 4, 6 an intake valve, 7 an intake port, 8 an exhaust valve, and 9 an exhaust port. The intake valve 6 opens and closes the intake port 7, while the exhaust valve 8 opens and closes the exhaust port 9.

As shown in FIG. 1, at the center part of the inside wall surface of the cylinder head 4, a spark plug 10 is arranged. A fuel injector 11 is arranged around the inside wall surface of the cylinder head 4. The spark plug 10 is configured to cause generation of a spark in accordance with an ignition signal. Further, the fuel injector 11 injects a predetermined amount of fuel into the combustion chamber 5 in accordance with an injection signal. In the present embodiment, as the fuel, gasoline with a stoichiometric air-fuel ratio of 14.6 is used.

The intake port 7 in each cylinder is connected through a corresponding intake runner 13 to a surge tank 14. The surge tank 14 is connected through an intake pipe 15 to an air cleaner 16. The intake port 7, intake runner 13, surge tank 14, intake pipe 15, etc., form an intake passage which leads air to the combustion chamber 5. Further, inside the intake pipe 15, a throttle valve 18 which is driven by a throttle valve drive actuator 17 is arranged. The throttle valve 18 can be turned by the throttle valve drive actuator 17 to thereby change the opening area of the intake passage.

On the other hand, the exhaust port 9 in each cylinder is connected to an exhaust manifold 19. The exhaust manifold 19 has a plurality of runners which are connected to the exhaust ports 9 and a header at which these runners are collected. The header of the exhaust manifold 19 is connected to an upstream side casing 21 which has an upstream side catalyst 20 built into it. The upstream side casing 21 is connected to a downstream side casing 24 which has a downstream side catalyst 23 built into it via an exhaust pipe 22. The exhaust port 9, exhaust manifold 19, upstream side casing 21, exhaust pipe 22, downstream side casing 24, etc., form an exhaust passage which discharges exhaust gas produced due to combustion of the air-fuel mixture in the combustion chamber 5.

Various control routines of the internal combustion engine arc performed by an electronic control unit (ECU) 31 based on outputs of sensors provided in the internal combustion engine, etc. The ECU 31 is comprised of a digital computer which is provided with components which are connected together through a bidirectional bus 32 such as a RAM (random access memory) 33, ROM (read only memory) 34, CPU (microprocessor) 35, input port 36, and output port 37. In the intake pipe 15, an air flow meter 39 detecting the flow rate of air which flows through the intake pipe 15 is arranged. The output of the air flow meter 39 is input through a corresponding AD converter 38 to the input port 36.

Further, at the header of the exhaust manifold 19, i.e., a upstream side of the upstream side catalyst 20, an upstream side air-fuel ratio sensor 40 detecting the air-fuel ratio of the exhaust gas which flows through the inside of the exhaust manifold 19 (that is, the exhaust gas which flows into the upstream side catalyst 20) is arranged. The output of the upstream air-fuel ratio sensor 40 is input through the corresponding AD converter 38 to the input port 36.

Further, inside the exhaust pipe 22, that is, at the downstream side of the upstream side catalyst 20, a downstream side air-fuel ratio sensor 41 for detecting an air-fuel ratio of the exhaust gas flowing through the inside of the exhaust pipe 22 (that is, exhaust gas flowing out from the upstream side catalyst 20) is arranged. The output of the downstream side air-fuel ratio sensor 41 is input through a corresponding AD converter 38 to the input port 36.

Further, an accelerator pedal 42 is connected to a load sensor 43 generating an output voltage proportional to the amount of depression of the accelerator pedal 42. The output voltage of the load sensor 43 is input through a corresponding AD converter 38 to the input port 36. The CPU 35 calculates an engine load based on the output of the load sensor 43.

A crank angle sensor 44 generates an output pulse every time the crankshaft rotates, for example, by 15 degrees. This output pulse is input to the input port 36. The CPU 35 calculates an engine speed based on the output of the crank angle sensor 44.

On the other hand, the output port 37 is connected through corresponding drive circuits 45 to the spark plugs 10, fuel injectors 11, and the throttle valve drive actuator 17.

Note that, the above-mentioned internal combustion engine is a nonsupercharged internal combustion engine fueled by gasoline, but the configuration of the internal combustion engine is not limited to the above configuration. Therefore, the cylinder array, mode of injection of fuel, configuration of the intake and exhaust systems, configuration of the valve operating mechanism, presence of any supercharger, and other specific parts of the configuration of the internal combustion engine may differ from the configuration shown in FIG. 1. For example, the fuel injectors 11 may be arranged to inject fuel into the intake ports 7.

<Explanation of Catalysts>

The upstream side catalyst 20 and the downstream side catalyst 23 arranged in the exhaust passage have similar configurations. The catalysts 20 and 23 are catalysts having oxygen storage abilities, for example, three-way catalysts. Specifically, the catalysts 20 and 23 are comprised of carriers made of ceramic on which a precious metal having a catalytic action (for example, platinum (Pt)) and a co-catalyst having an oxygen storage ability (for example, ceria ($CeO_2$)) are carried.

Figure 2:
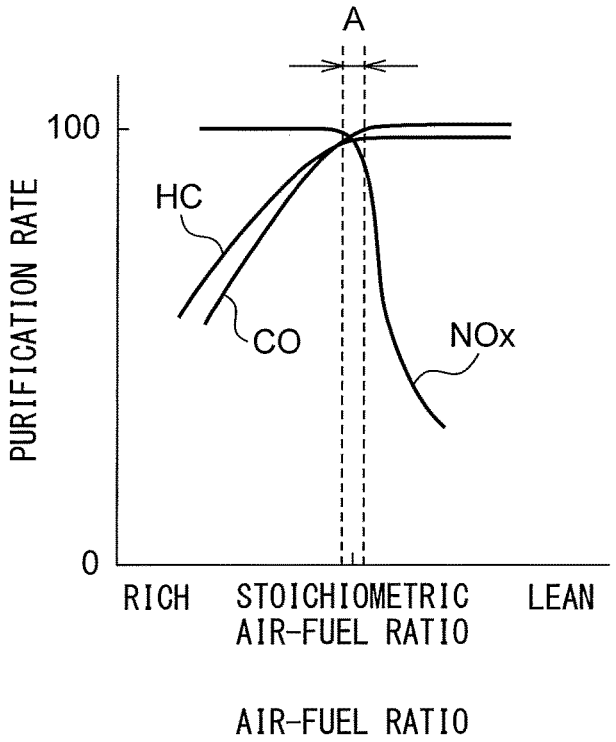
FIG. 2 shows the purification characteristics of a three-way catalyst.

FIG. 2 shows the purification characteristics of a three-way catalyst. As shown in FIG. 2, the purification rates of unburned gas (HC, CO) and nitrogen oxides ($NO_X$) by the catalysts 20 and 23 become extremely high when the air-fuel ratio of the exhaust gas flowing into the catalysts 20 and 23 is in the region near the stoichiometric air-fuel ratio (purification window A in FIG. 2). Therefore, the catalysts 20 and 23 can effectively remove unburned gas and $NO_X$ if the air-fuel ratio of the exhaust gas is maintained at the stoichiometric air-fuel ratio.

Further, the catalysts 20 and 23 store or release oxygen in accordance with the air-fuel ratio of the exhaust gas by the co-catalyst. Specifically, the catalysts 20 and 23 store excess oxygen in the exhaust gas when the air-fuel ratio of the exhaust gas is leaner than the stoichiometric air-fuel ratio. On the other hand, the catalysts 20 and 23 release the amount of additional oxygen required for making the unburned gas oxidize when the air-fuel ratio of the exhaust gas is richer than the stoichiometric air-fuel ratio. As a result, even if the air-fuel ratio of the exhaust gas is somewhat off from the stoichiometric air-fuel ratio, the air-fuel ratio on the surface of the catalysts 20 and 23 is maintained near the stoichiometric air-fuel ratio and the unburned gas and $NO_X$ are effectively removed at the catalysts 20 and 23.

Note that, so long as the catalysts 20 and 23 have catalytic actions and oxygen storage abilities, they may be catalysts other than three-way catalysts.

<Constitutions of Air-Fuel Ratio Sensors>

Figure 3:
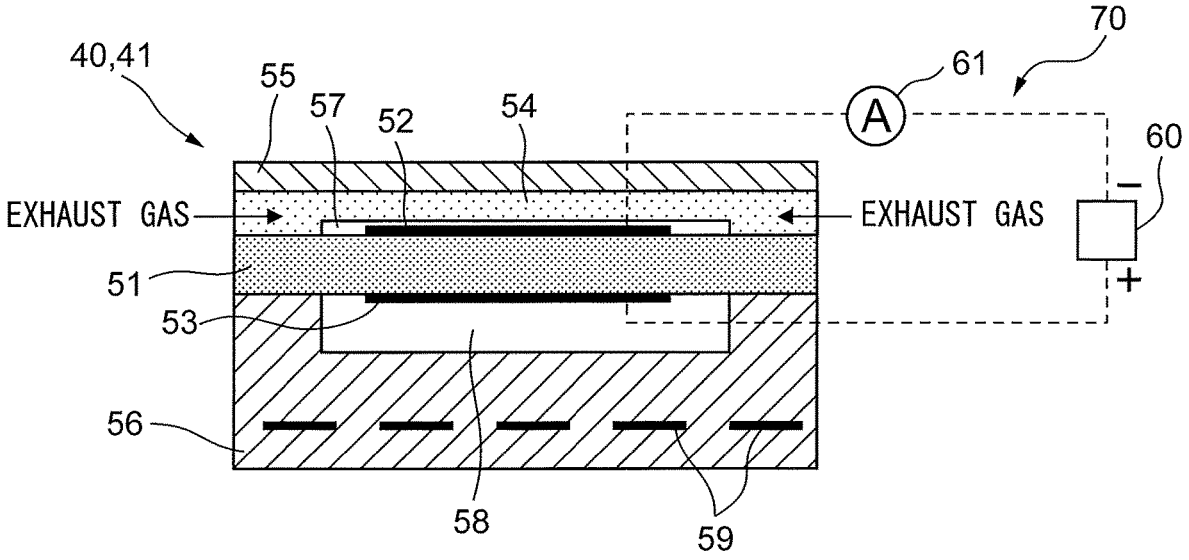
FIG. 3 is a schematic cross-sectional view of an air-fuel ratio sensor.
Figure 4:
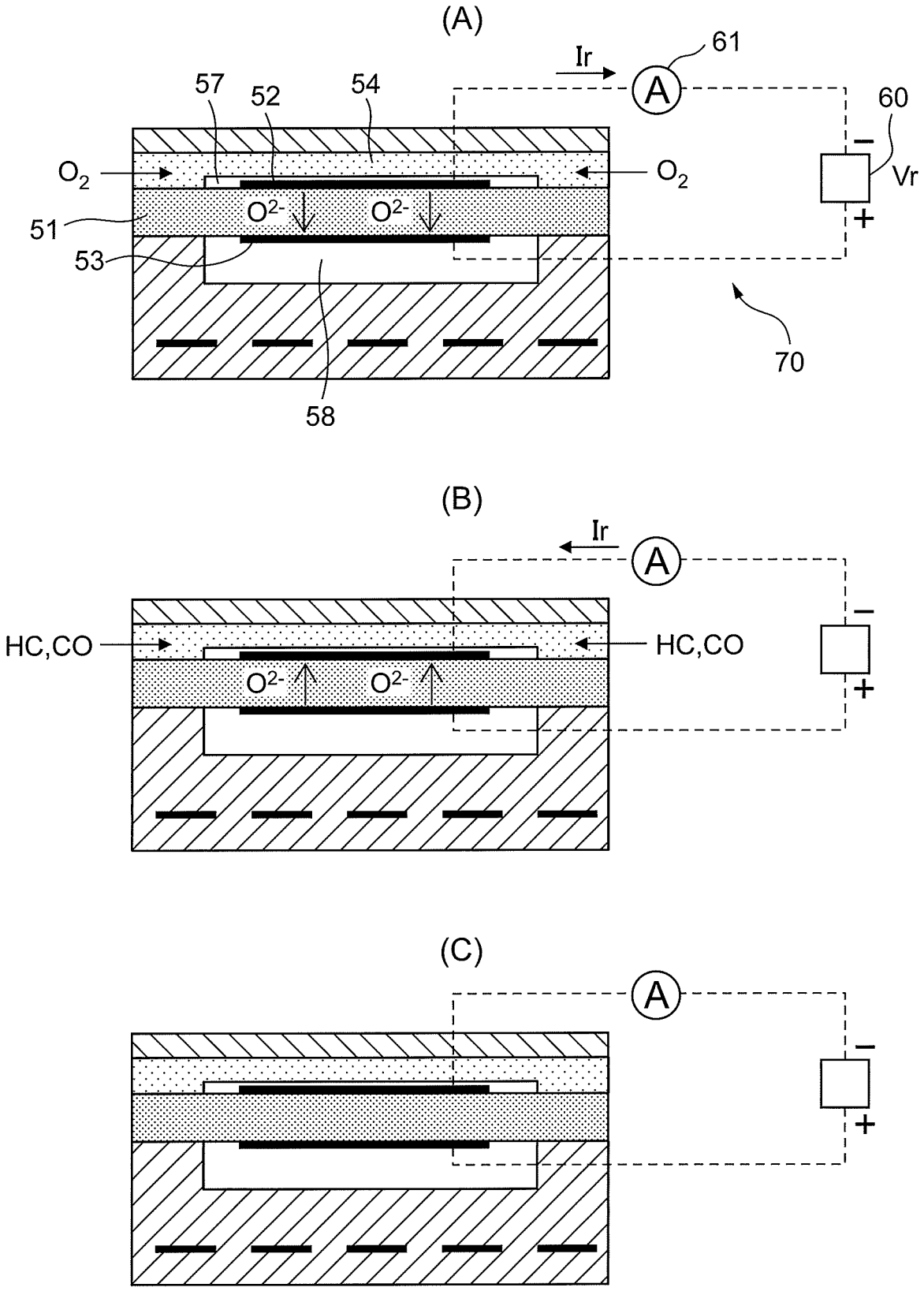
FIG. 4 is a view schematically showing an operation of the air-fuel ratio sensor.

The upstream side air-fuel ratio sensor 40 and the downstream side air-fuel ratio sensor 41 arranged in the exhaust passage have similar constitutions. FIG. 3 is a schematic cross-sectional view of the air-fuel ratio sensors 40 and 41. As will be understood from FIG. 3, in the present embodiment, the air-fuel ratio sensors 40 and 41 are respectively a one-cell type air-fuel ratio sensor having one sensor cell including a solid electrolyte layer and a pair of electrodes.

As shown in FIG. 3, each of the air-fuel ratio sensors 40 and 41 is provided with a solid electrolyte layer 51, an exhaust side electrode 52 arranged on one side surface of the solid electrolyte layer 51, an atmosphere side electrode 53 arranged on the other side surface of the solid electrolyte layer 51, a diffusion regulating layer 54 for regulating diffusion of the exhaust gas, a protective layer 55 for protecting the diffusion regulating layer 54, and a heater part 56 for heating the air-fuel ratio sensors 40 and 41.

The diffusion regulating layer 54 is provided on one side surface of the solid electrolyte layer 51, while the protective layer 55 is provided on the side surface at the opposite side to the side surface of the solid electrolyte layer 51 side of the diffusion regulating layer 54. In the present embodiment, a measured gas chamber 57 is formed between the solid electrolyte layer 51 and the diffusion regulating layer 54. A part of the exhaust gas flowing through the exhaust passage is introduced through the diffusion regulating layer 54 to the measured gas chamber 57. Further, the exhaust side electrode 52 is arranged inside the measured gas chamber 57. Therefore, the exhaust side electrode 52 is exposed to the exhaust gas through the diffusion regulating layer 54. Note that, the measured gas chamber 57 does not necessarily have to be provided. Each of the air-fuel ratio sensors 40 and 41 may be configured so that the diffusion regulating layer 54 directly contacts the surface of the exhaust side electrode 52.

The heater part 56 is provided on the other side surface of the solid electrolyte layer 51. A reference gas chamber 58 is formed between the solid electrolyte layer 51 and the heater part 56. Reference gas is introduced inside the reference gas chamber 58. In the present embodiment, the reference gas chamber 58 is open to the atmosphere, so the atmosphere is introduced into the reference gas chamber 58 as the reference gas. The atmosphere side electrode 53 is arranged inside the reference gas chamber 58. Therefore, the atmosphere side electrode 53 is exposed to the reference gas (atmosphere).

The heater part 56 is provided with a plurality of heaters 59. Due to the heaters 59, it is possible to control the temperature of each of the air-fuel ratio sensors 40 and 41, in particular the temperature of the solid electrolyte layer 51. The heater part 56 has a heat generating capacity sufficient for heating the solid electrolyte layer 51 until activation.

The solid electrolyte layer 51 is a thin sheet member having oxide ion conductivity. The solid electrolyte layer 51 is, for example, a sintered body comprised of $ZrO_2$ (zirconia), $HfO_2$, $ThO_2$, $Bi_2O_3$, etc., to which CaO, MgO, $Y_2O_3$, $Yb_2O_3$, etc., is added as a stabilizer. Further, the diffusion regulating layer 54 is formed by a porous sintered body of alumina, magnesia, silica, spinel, mullite, or other heat resistant inorganic substance. Furthermore, the exhaust side electrode 52 and the atmosphere side electrode 53 are formed by platinum or another precious metal having a high catalytic activity.

Further, an electrical circuit 70 is connected to the exhaust side electrode 52 and the atmosphere side electrode 53. The electrical circuit 70 includes a voltage application device 60 and a current detection device 61. The voltage application device 60 applies voltage to each of the air-fuel ratio sensors 40 and 41 so that the potential of the atmosphere side electrode 53 becomes higher than the potential of the exhaust side electrode 52. Therefore, the exhaust side electrode 52 functions as a negative electrode, while the atmosphere side electrode 53 functions as a positive electrode. The output port 37 of the ECU 31 is connected through a corresponding drive circuit 45 to the voltage application device 60. Therefore, the ECU 31 can control the voltage applied to each of the air-fuel ratio sensors 40 and 41 through the voltage application device 60.

Further, the current detection device 61 detects the current flowing between the exhaust side electrode 52 and the atmosphere side electrode 53, that is, the output current of each of the air-fuel ratio sensors 40 and 41. The output of the current detection device 61 is input through the corresponding AD converter 38 to the input port 36 of the ECU 31. Therefore, the ECU 31 can acquire the output current of each of the air-fuel ratio sensors 40 and 41 detected by the current detection device 61.

<Operation of Air-Fuel Ratio Sensors>

Next, referring to FIGS. 4A to 4C, the basic operation of the air-fuel ratio sensors 40 and 41 will be explained. FIGS. 4A to 4C are views schematically showing the operation of the air-fuel ratio sensors 40 and 41. The air-fuel ratio sensors 40 and 41 are arranged in the exhaust passage so that the outer circumferential surfaces of the protective layers 55 and the diffusion regulating layers 54 are exposed to the exhaust gas. Further, the atmosphere is introduced to the reference gas chambers 58 of the air-fuel ratio sensors 40 and 41.

As explained above, each solid electrolyte layer 51 has oxide ion conductivity. For this reason, if a difference arises in the concentrations of oxygen between the both side surfaces of the activated solid electrolyte layer 51, an electromotive force E is generated trying to make the oxide ions move from the high concentration surface side to the low concentration surface side. This characteristic is called the "oxygen cell characteristic".

On the other hand, if a potential difference is given between the both side surfaces of the solid electrolyte layer 51, oxide ions move so that a ratio of oxygen concentration corresponding to the potential difference occurs between the both side surfaces of the solid electrolyte layer. This characteristic is called the "oxygen pumping characteristic".

When the air-fuel ratio of the exhaust gas flowing into each of the air-fuel ratio sensors 40 and 41 is leaner than the stoichiometric air-fuel ratio, since the oxygen concentration in the exhaust gas is high, the ratio of the oxygen concentration between the both side surfaces of the solid electrolyte layer 51 is not so large. For this reason, if setting the voltage Vr applied to each of the air-fuel ratio sensors 40 and 41 to a suitable value, the ratio of the oxygen concentration between the both side surfaces of the solid electrolyte layer 51 becomes smaller than the ratio of oxygen concentration corresponding to the sensor applied voltage Vr. For this reason, to enable the ratio of the oxygen concentration between the both side surfaces of the solid electrolyte layer 51 to become close to the ratio of oxygen concentration corresponding to the sensor applied voltage Vr, as shown in FIG. 4A, oxide ions move from the exhaust side electrode 52 to the atmosphere side electrode 53. As a result, a current Ir flows from the positive electrode of the voltage application device 60 to the negative electrode of the voltage application device 60. At this time, a positive current is detected by the current detection device 61. Further, the value of the current Ir becomes larger the higher the oxygen concentration in the exhaust gas flowing into the measured gas chamber 57, that is, the higher the air-fuel ratio of the exhaust gas.

On the other hand, when the air-fuel ratio of the exhaust gas flowing into each of the air-fuel ratio sensors 40 and 41 is richer than the stoichiometric air-fuel ratio, the oxygen on the exhaust side electrode 52 reacts with the unburned gases in the exhaust gas and is removed. For this reason, the oxygen concentration at the exhaust side electrode 52 becomes extremely low and the ratio of oxygen concentration between the both side surfaces of the solid electrolyte layer 51 becomes larger. For this reason, if setting the sensor applied voltage Vr to a suitable value, the ratio of the oxygen concentration between the both side surfaces of the solid electrolyte layer 51 becomes larger than the ratio of the oxygen concentration corresponding to the sensor applied voltage Vr. For this reason, as shown in FIG. 4B, oxide ions move from the atmosphere side electrode 53 to the exhaust side electrode 52 so that the ratio of the oxygen concentration between the both side surfaces of the solid electrolyte layer 51 approaches the ratio of the oxygen concentration corresponding to the sensor applied voltage Vr. As a result, current Ir flows from the negative electrode of the voltage application device 60 to the positive electrode of the voltage application device 60. At this time, a negative current is detected by the current detection device 61. Further, the absolute value of the current Ir becomes larger the higher the concentration of unburned gases in the exhaust gas flowing into the measured gas chamber 57, that is, the lower the air-fuel ratio of the exhaust gas.

Further, when the air-fuel ratio of the exhaust gas flowing into each of the air-fuel ratio sensors 40 and 41 is the stoichiometric air-fuel ratio, the amounts of oxygen and unburned gases in the exhaust gas become the chemical equivalent ratios. For this reason, due to the catalytic action of the exhaust side electrode 52, the two completely burn and the ratio of the oxygen concentration between the both side surfaces of the solid electrolyte layer 51 is maintained at the oxygen concentration ratio corresponding to the applied voltage Vr. For this reason, as shown in FIG. 4C, no movement of oxide ions occurs due to the oxygen pumping characteristic and the current detected by the current detection device 61 becomes zero.

Therefore, the values of the output currents of the air-fuel ratio sensors 40 and 41 fluctuate according to the air-fuel ratio of the exhaust gas flowing into the air-fuel ratio sensors 40 and 41. For this reason, the ECU 31 can estimate the air-fuel ratio of the exhaust gas based on the currents detected by the current detection device 61. Note that, "the air-fuel ratio of the exhaust gas" means the ratio of the mass of the air to the mass of the fuel supplied until the exhaust gas is generated (mass of air/mass of fuel) and is estimated from the oxygen concentration and reducing gas concentration in the exhaust gas.

<Specific Example of Electrical Circuits>

Figure 5:
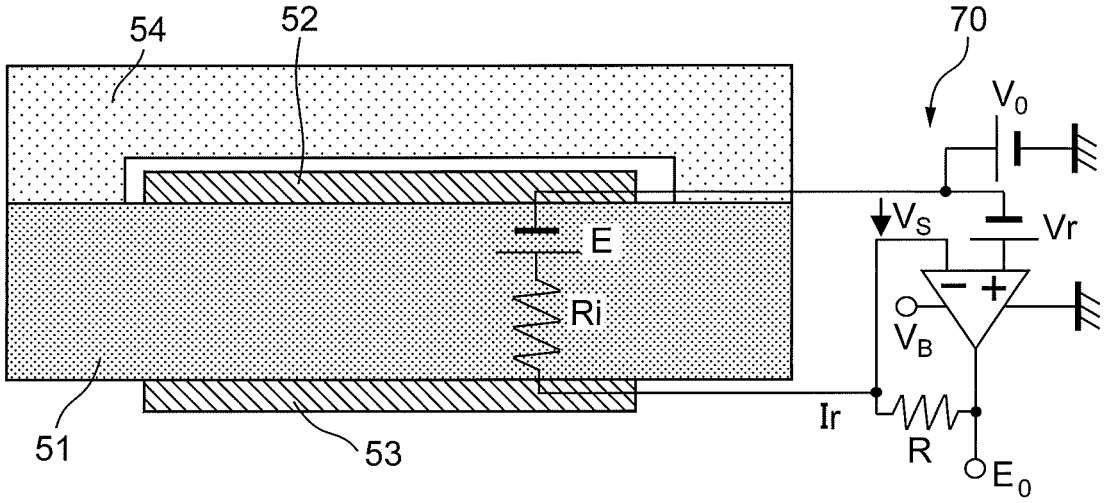
FIG. 5 shows a specific example of an electrical circuit.

FIG. 5 shows a specific example of the electrical circuits 70. In the illustrated example, the electromotive force generated by the oxygen cell characteristic is designated by "E", the internal resistance of the solid electrolyte layer 51 by "Ri", the potential difference between the electrodes 52 and 53 by "Vs", and the sensor applied voltage applied by the voltage application device 60 to the air-fuel ratio sensors 40 and 41 by "Vr".

As will be understood from FIG. 5, the voltage application device 60 basically performs negative feedback control so that the electromotive force E generated by the oxygen cell characteristic matches with the sensor applied voltage Vr. The voltage application device 60 performs negative feedback control so that the potential difference Vs becomes the sensor applied voltage Vr even when a change in the ratio of oxygen concentration between the both side surfaces of the solid electrolyte layers 51 causes a change in the potential difference Vs between two electrodes 52 and 53.

If the air-fuel ratio of the exhaust gas is the stoichiometric air-fuel ratio and the ratio of the oxygen concentration between the both side surfaces of a solid electrolyte layer 51 does not change, the ratio of the oxygen concentration between the both side surfaces of the solid electrolyte layer 51 becomes a ratio of oxygen concentration corresponding to the sensor applied voltage Vr. In this case, the electromotive force E and the potential difference Vs match the sensor applied voltage Vr, so the current Ir does not flow.

On the other hand, if the air-fuel ratio of the exhaust gas is an air-fuel ratio different from the stoichiometric air-fuel ratio and the ratio of the oxygen concentration between the both side surfaces of a solid electrolyte layer 51 changes, the ratio of the oxygen concentration between the both side surfaces of the solid electrolyte layer 51 differs from the oxygen concentration ratio corresponding to the sensor applied voltage Vr. In this case, the electromotive force E becomes a value different from the sensor applied voltage Vr. As a result, due to negative feedback control, a potential difference Vs is given to the electrodes 52 and 53 so as to make the oxide ions move between the both side surfaces of the solid electrolyte layer 51 so that the electromotive force E matches the sensor applied voltage Vr. Further, current Ir flows along with movement of oxide ions. As a result, the electromotive force E converges at the sensor applied voltage Vr, while the potential difference Vs also converge at the sensor applied voltage Vr.

Further, the current detection device 61 detects the voltage $E_0$ for detecting the current Ir. Here, $E_0$ is expressed like in the following formula (1):

$$E_0 = Vr + V_0 + IrR \quad (1)$$

Here, $V_0$ is the offset voltage (for example, 3V) applied so that $E_0$ does not become a negative value, while R is the value of the resistance shown in FIG. 5.

In formula (1), the sensor applied voltage Vr, the offset voltage $V_0$, and the resistance value R are constant, so the voltage $E_0$ changes in accordance with the current Ir. Therefore, the current detection device 61 can calculate the current Ir based on the voltage $E_0$.

Note that, the electrical circuits 70 may be different from the configuration shown in FIG. 5 so long as able to apply voltage to the air-fuel ratio sensors 40 and 41 and to detect the output currents of the air-fuel ratio sensors 40 and 41.

<Output Characteristics of Air-Fuel Ratio Sensors>

Figure 6:
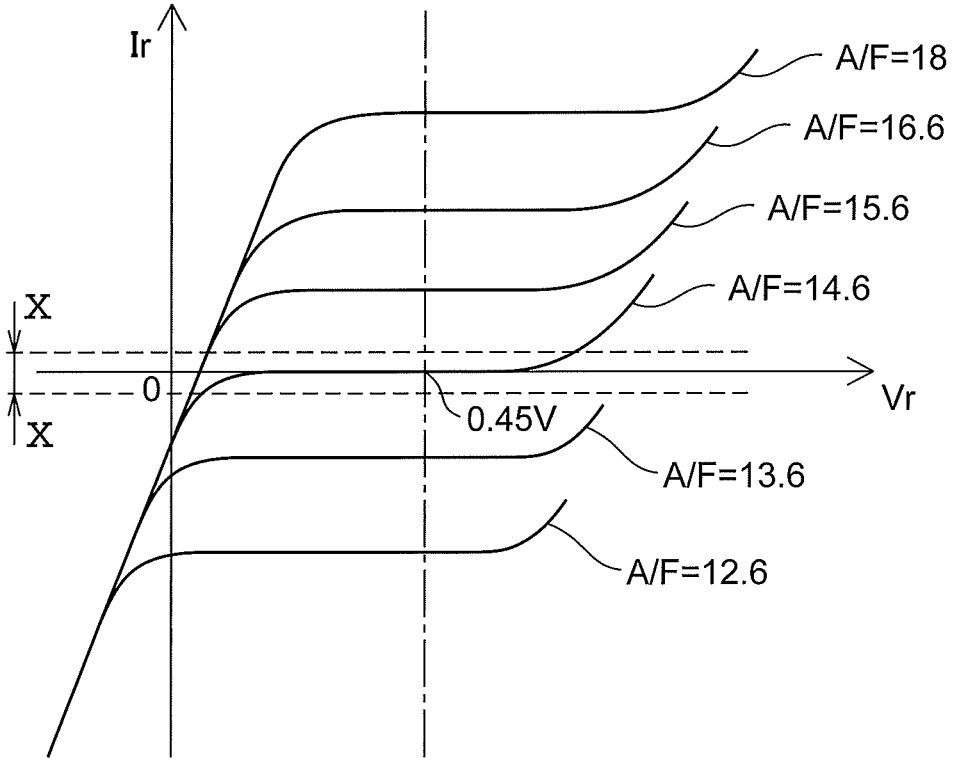
FIG. 6 is a view showing a voltage-current characteristic of the air-fuel ratio sensor.

As a result of the above-mentioned principle, each of the air-fuel ratio sensors 40 and 41 has a voltage-current (V-I) characteristic such as shown in FIG. 6. As shown in FIG. 6, in the region of the sensor applied voltage Vr of 0 or less and near 0, if the exhaust air-fuel ratio is constant, the output current Ir becomes larger as the sensor applied voltage Vr rises. Note that, the voltage region where the output current Ir changes proportionally to the sensor applied voltage Vr will be referred to as the "proportional region".

In the proportional region, the sensor applied voltage Vr is low, so the flow rate of oxide ions able to move through the solid electrolyte layer 51 is small. In this case, the speed of movement of oxide ions moving through the solid electrolyte layer 51 along with the application of voltage becomes slower than the speed of introduction of the exhaust gas introduced into the measured gas chamber 57 through the diffusion regulating layer 54. For this reason, the flow rate of the oxide ions able to move through the solid electrolyte layer 51 changes according to the sensor applied voltage Vr and the output current Ir increases along with the increase of the sensor applied voltage Vr. Note that, the output current Ir becomes a negative value when the sensor applied voltage Vr is 0 because an electromotive force corresponding to the ratio of the oxygen concentration between the both side surfaces of the solid electrolyte layer 51 is generated due to the oxygen cell characteristic.

As shown in FIG. 6, if the sensor applied voltage Vr becomes a predetermined value or more, the output current Ir is maintained at a substantially constant value regardless of the value of the sensor applied voltage Vr. This saturated current is called the "limit current", while the voltage region where the limit current is generated is called the "limit current region". In the limit current region, the sensor applied voltage Vr is higher than the proportional region, so the flow rate of oxide ions able to move through the solid electrolyte layer 51 becomes greater than the proportional region. In this case, the speed of movement of the oxide ions moving through the solid electrolyte layer 51 along with application of voltage becomes faster than the speed of introduction of exhaust gas introduced to the measured gas chamber 57 through the diffusion regulating layer 54. For this reason, the flow rate of the oxide ions able to move through the solid electrolyte layer 51 does not change much at all in accordance with the sensor applied voltage Vr, so the output current Ir is maintained at a substantially constant value regardless of the value of the sensor applied voltage Vr. On the other hand, the flow rate of the oxide ions able to move through the solid electrolyte layer 51 changes in accordance with the ratio of the oxygen concentration between the both side surfaces of the solid electrolyte layer 51, so the output current Ir changes in accordance with the air-fuel ratio of the exhaust gas.

As shown in FIG. 6, in the region where the sensor applied voltage Vr is extremely high, if the exhaust air-fuel ratio is constant, the output current Ir becomes larger the higher the sensor applied voltage Vr. If the sensor applied voltage Vr becomes extremely high, at the exhaust side electrode 52, the water in the exhaust gas is decomposed. The oxide ions produced by decomposition of water move through the inside of the solid electrolyte layer 51 from the exhaust side electrode 52 to the atmosphere side electrode 53. As a result, the current resulting from the decomposition of water is also detected as the output current Ir, so the output current Ir becomes larger than the limit current. This voltage region will be called the "water decomposition region".

Figure 7:
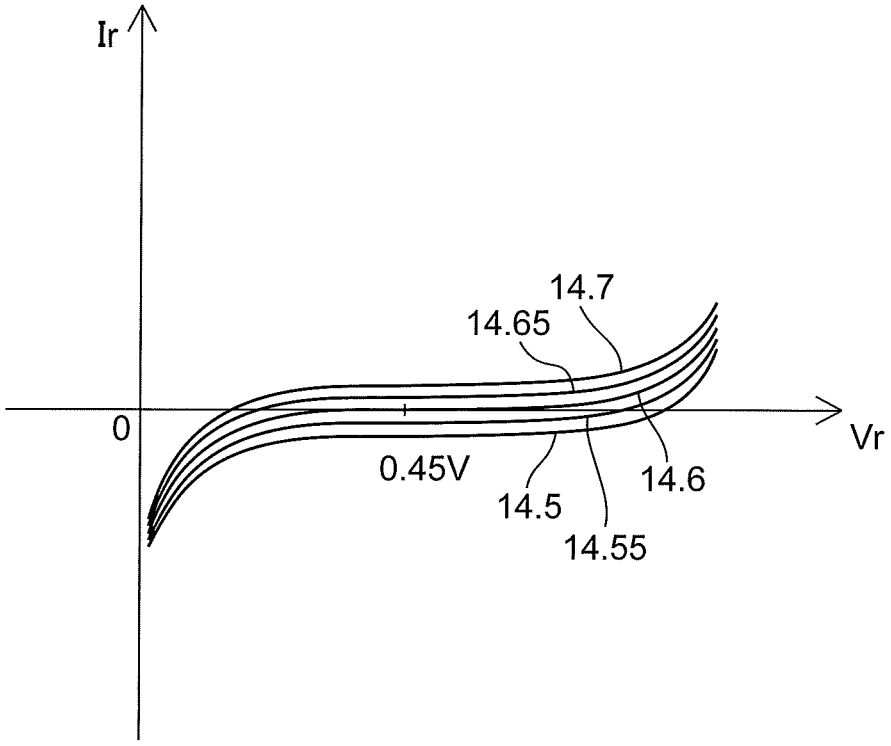
FIG. 7 is a view showing a voltage-current characteristic in an X-X region of FIG. 6.

FIG. 7 is a view showing the voltage-current characteristic in the X-X region of FIG. 6. As will be understood from FIG. 7, even in the limit current region, when the air-fuel ratio of the exhaust gas is constant, the output current Ir becomes slightly larger as the sensor applied voltage Vr rises. For this reason, the value of the sensor applied voltage Vr when the output current Ir becomes zero changes according to the air-fuel ratio of the exhaust gas.

For example, if the air-fuel ratio of the exhaust gas is the stoichiometric air-fuel ratio (14.6), the value of the sensor applied voltage Vr when the output current Ir becomes zero is 0.45V. If the air-fuel ratio of the exhaust gas is lower than the stoichiometric air-fuel ratio (is rich), the value of the sensor applied voltage Vr when the output current Ir becomes zero is higher than 0.45V. On the other hand, if the air-fuel ratio of the exhaust gas is higher than the stoichiometric air-fuel ratio (is lean), the value of the sensor applied voltage Vr when the output current Ir becomes zero is lower than 0.45V.

Figure 8:
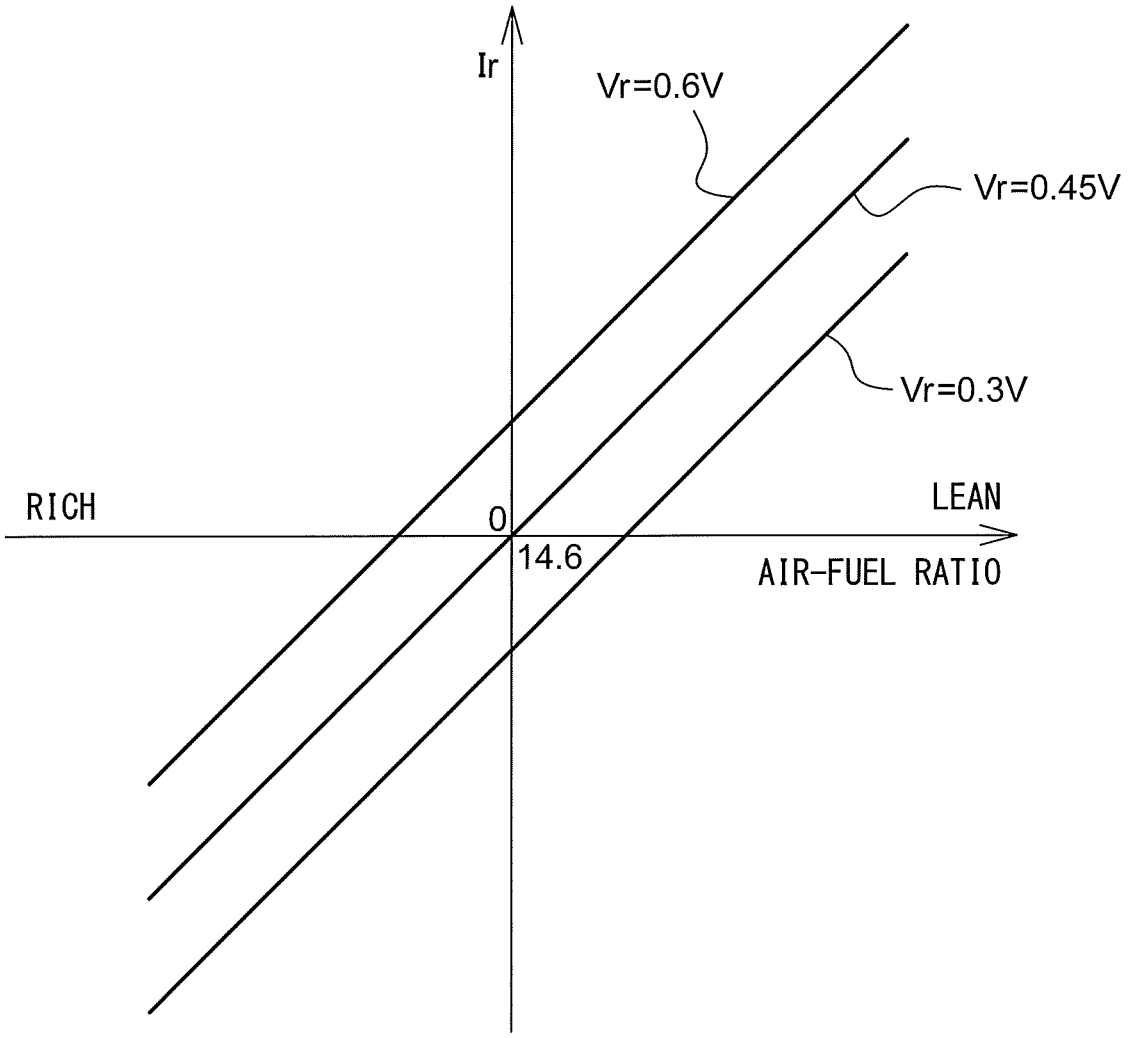
FIG. 8 is a graph showing a relationship between an air-fuel ratio of exhaust gas and an output current.
Figure 9:
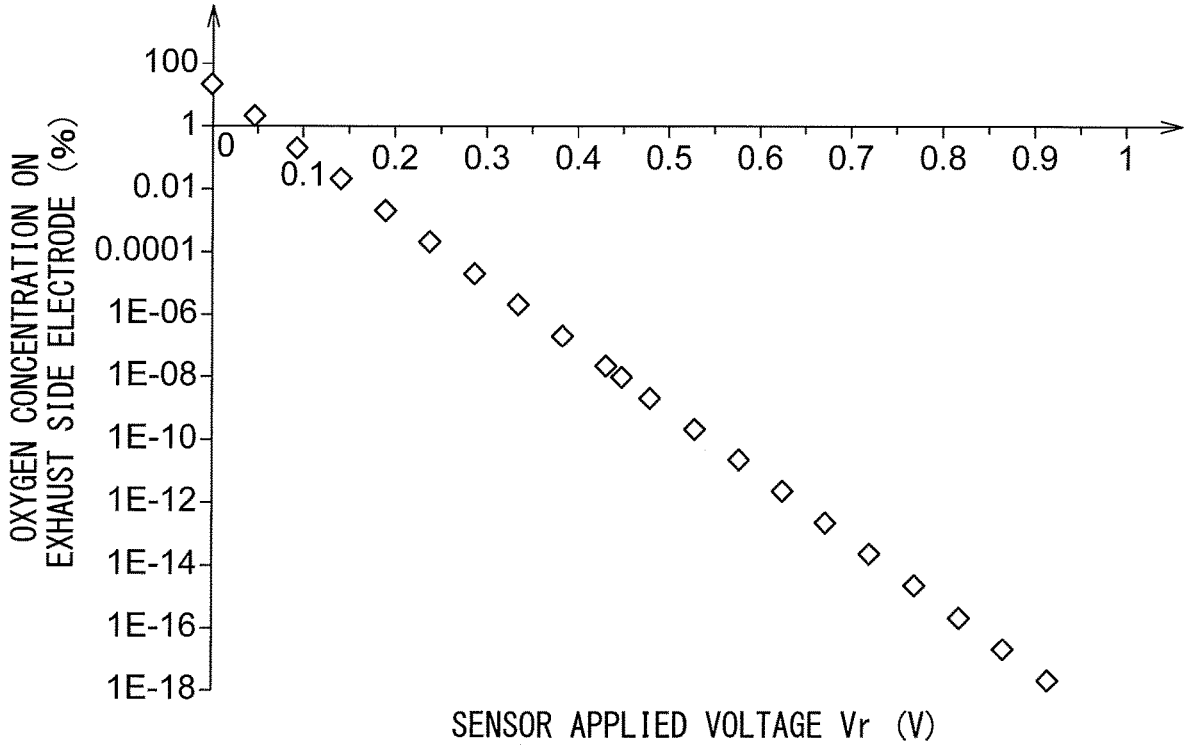
FIG. 9 is a graph showing a relationship between a sensor applied voltage and an oxygen concentration on an exhaust side electrode when the output current is zero.

FIG. 8 is a graph showing the relationship between an air-fuel ratio of the exhaust gas and the output current Ir. In FIG. 8, the region near the stoichiometric air-fuel ratio is enlarged. FIG. 8 shows the relationship between the air-fuel ratio of the exhaust gas and the output current Ir when the sensor applied voltage Vr is 0.3V, 0.45V, and 0.6V. FIG. 9 is a graph showing the relationship between the sensor applied voltage Vr and the oxygen concentration on the exhaust side electrode when the output current is zero. In FIG. 9, the y-axis (oxygen concentration on exhaust side electrode) is shown logarithmically. The richer the air-fuel ratio of the exhaust gas, the lower the oxygen concentration on the exhaust side electrode. As will be understood from FIG. 8 and FIG. 9, as the sensor applied voltage Vr becomes higher, the air-fuel ratio of the exhaust gas when the output current Ir becomes zero becomes lower (becomes richer).

<Control System of Internal Combustion Engine>

Figure 10:
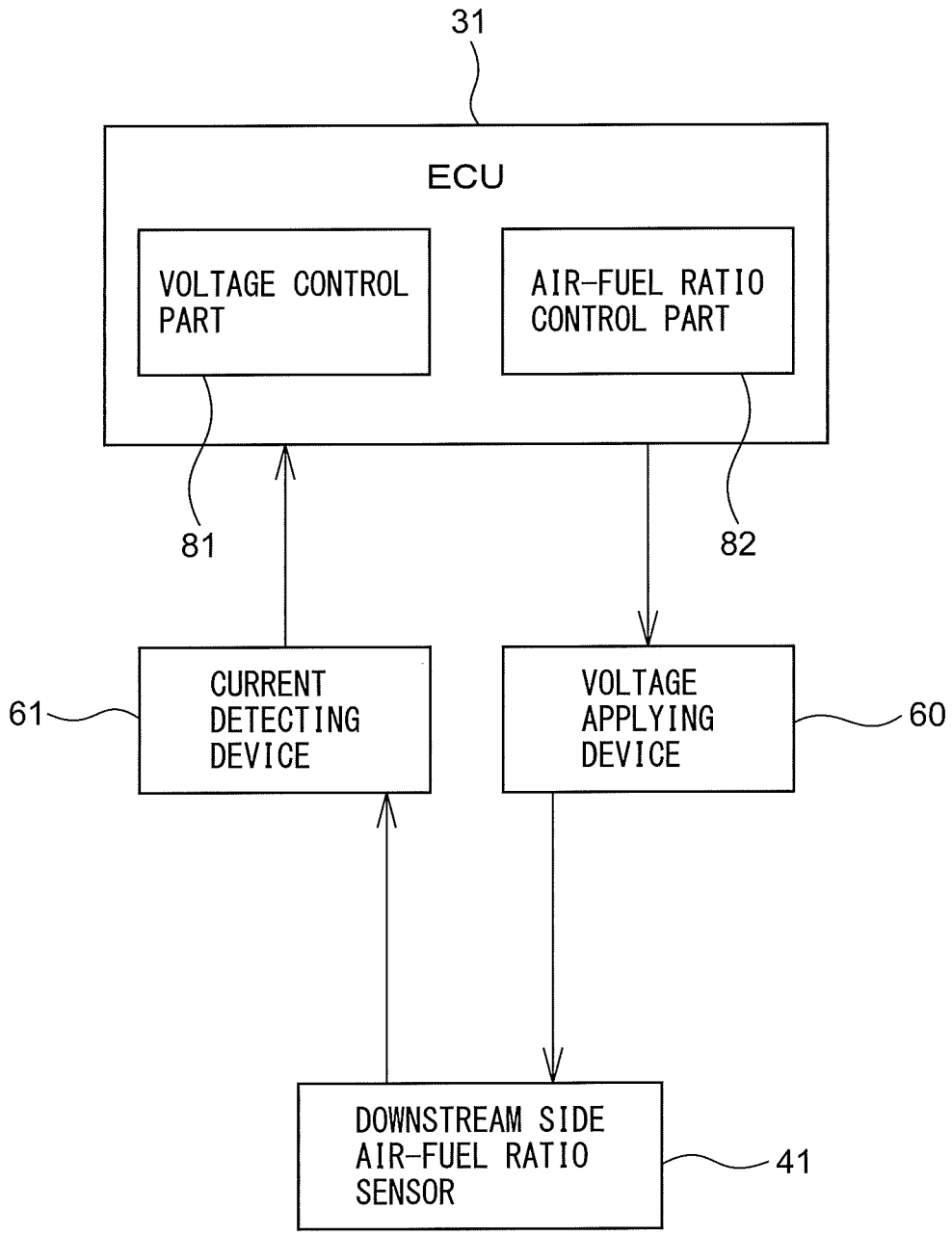
FIG. 10 is a view schematically showing a configuration of a control system of an internal combustion engine according to the first embodiment of the present invention.

Below, a control system of an internal combustion engine according to the first embodiment of the present invention will be explained. FIG. 10 is a view schematically showing the configuration of the control system of the internal combustion engine according to the first embodiment of the present invention. The control system of an internal combustion engine is provided with the downstream side air-fuel ratio sensor 41, current detecting device 61, voltage applying device 60, voltage control part 81, and air-fuel ratio control part 82.

In the present embodiment, the ECU 31 has the voltage control part 81 and air-fuel ratio control part 82. The voltage control part 81 and air-fuel ratio control part 82 are functional blocks realized by a program stored in the ROM 33 of the ECU 31 being run by the CPU 35 of the ECU 31.

The air-fuel ratio control part 82 controls the air-fuel ratio of the air-fuel mixture supplied to the combustion chambers 5 and in turn the air-fuel ratio of the exhaust gas flowing into the upstream side catalyst 20. Specifically, the air-fuel ratio control part 82 changes the amount of fuel supplied from the fuel injectors 11 to the combustion chambers 5 to control the air-fuel ratio of the air-fuel mixture.

The voltage control part 81 controls the voltage applied to the downstream side air-fuel ratio sensor 41 (below, simply referred to as the "applied voltage") through the voltage applying device 60. As shown in FIG. 8, if the applied voltage is changed, the relationship between the air-fuel ratio of the exhaust gas flowing into the downstream side air-fuel ratio sensor 41 (below, referred to as the "inflowing exhaust gas") and the output current of the downstream side air-fuel ratio sensor 41, that is, the relationship between the air-fuel ratio of the exhaust gas flowing out from the upstream side catalyst 20 and the output current of the downstream side air-fuel ratio sensor 41, changes.

If current flows at the downstream side air-fuel ratio sensor 41, the output current of the downstream side air-fuel ratio sensor 41 changes due to fluctuations in the temperature or pressure of the exhaust gas, circuit error, etc. On the other hand, if the output current of the downstream side air-fuel ratio sensor 41 is zero, variation of the output current of the downstream side air-fuel ratio sensor 41 due to fluctuation of the temperature or pressure of the exhaust gas, circuit error, etc. is reduced.

In the present embodiment, the voltage control part 81 sets the applied voltage to the reference voltage determined so that the output current of the downstream side air-fuel ratio sensor 41 when the air-fuel ratio of the inflowing exhaust gas is the stoichiometric air-fuel ratio becomes zero. By doing this, it is possible to precisely detect the air-fuel ratio of the inflowing exhaust gas being the stoichiometric air-fuel ratio and in turn possible to quickly detect changes in the characteristics of the exhaust gas flowing out from the upstream side catalyst 20. For this reason, it is possible to control the air-fuel ratio of the air-fuel mixture based on the air-fuel ratio detected by the downstream side air-fuel ratio sensor 41 to thereby keep the exhaust emissions from deteriorating.

However, aging, individual variations, etc., sometimes cause deviation in the output of the downstream side air-fuel ratio sensor 41. If deviation in the output of a downstream side air-fuel ratio sensor 41 occurs, even if the air-fuel ratio of the inflowing exhaust gas is the stoichiometric air-fuel ratio, the output current of the downstream side air-fuel ratio sensor 41 becomes a value other than zero. As a result, the precision of detection of the air-fuel ratio by the downstream side air-fuel ratio sensor 41, in particular the precision of detection of the stoichiometric air-fuel ratio, deteriorates.

For this reason, in order to keep the exhaust emissions from deteriorating due to deterioration of the precision of detection of the air-fuel ratio, it is necessary to correct deviation of the output of the downstream side air-fuel ratio sensor 41. For example, it may be considered to set the output current of the downstream side air-fuel ratio sensor 41 detected when the air-fuel ratio of the inflowing exhaust gas is the stoichiometric air-fuel ratio to a correction amount and subtract the correction amount from the actually detected output current of the downstream side air-fuel ratio sensor 41.

However, with this method, the deviation in the output of the downstream side air-fuel ratio sensor 41 is corrected by processing, therefore the characteristics of the downstream side air-fuel ratio sensor 41 remain off from the initial settings. For this reason, variation in the output current of the downstream side air-fuel ratio sensor 41 is liable to cause the precision of detection of the air-fuel ratio to fall.

As opposed to this, in the present embodiment, if deviation in the output of the downstream side air-fuel ratio sensor 41 occurs, the applied voltage is changed to render the output current of the downstream side air-fuel ratio sensor 41 corresponding to the stoichiometric air-fuel ratio zero. Specifically, the voltage control part 81 corrects the reference voltage so that the output current of the downstream side air-fuel ratio sensor 41 detected by the current detecting device 61 when it is judged that the air-fuel ratio of the inflowing exhaust gas is the stoichiometric air-fuel ratio becomes zero. By doing this, the characteristics of the downstream side air-fuel ratio sensor 41 become the initial ideal state and the variation in the output current of the downstream side air-fuel ratio sensor 41 is reduced. As a result, it is possible to keep the precision of detection of the air-fuel ratio by the downstream side air-fuel ratio sensor 41 from falling.

As explained above, in order to correct the reference voltage, it is necessary to make the air-fuel ratio of the inflowing exhaust gas the stoichiometric air-fuel ratio. If the oxygen storage amount of the upstream side catalyst 20 changes between zero and the maximum oxygen storage amount, the air-fuel ratio of the inflowing exhaust gas at least temporarily becomes the stoichiometric air-fuel ratio by the exhaust purification characteristics of the upstream side catalyst 20. For this reason, the air-fuel ratio control part 82 controls the air-fuel ratio of the air-fuel mixture so that the oxygen storage amount of the upstream side catalyst 20 changes between zero and the maximum oxygen storage amount.

Further, when the air-fuel ratio of the inflowing exhaust gas is the stoichiometric air-fuel ratio, the amount of change of the output current of the downstream side air-fuel ratio sensor 41 becomes smaller. For this reason, the voltage control part 81 corrects the reference voltage so that the output current of the downstream side air-fuel ratio sensor 41 detected by the current detecting device 61 becomes zero when the amount of change per predetermined time of the output current of the downstream side air-fuel ratio sensor 41 is equal to or less than a predetermined value. By doing this, it is possible to precisely correct the reference voltage applied to the downstream side air-fuel ratio sensor 41 based on the output current when the air-fuel ratio of the inflowing exhaust gas is the stoichiometric air-fuel ratio.

In the present embodiment, the air-fuel ratio control part 82 performs fuel cut control to stop the supply of fuel to the combustion chambers 5 when predetermined conditions for execution are satisfied. In the fuel cut control, the air-fuel ratio control part 82 stops the injection of fuel from the fuel injectors 11 to stop the supply of fuel to the combustion chambers 5. The predetermined conditions for execution, for example, are satisfied when the amount of depression of the accelerator pedal 42 is zero or substantially zero (that is, the engine load is zero or substantially zero) and the engine speed is equal to or higher than a predetermined speed higher than the speed at the time of idling.

If fuel cut control is performed, air or a gas similar to air is discharged into the exhaust passage and flows into the upstream side catalyst 20. As a result, a large amount of oxygen flows into the upstream side catalyst 20 and the oxygen storage amount of the upstream side catalyst 20 reaches the maximum oxygen storage amount. Further, if the oxygen storage amount of the upstream side catalyst 20 reaches the maximum oxygen storage amount, a large amount of oxygen also flows into the downstream side catalyst 23 and the oxygen storage amount of the downstream side catalyst 23 also reaches the maximum oxygen storage amount.

For this reason, if fuel cut control is continued for equal to or greater than a predetermined time, the oxygen storage amounts of the upstream side catalyst 20 and downstream side catalyst 23 become the maximum oxygen storage amounts. When the oxygen storage amounts of the upstream side catalyst 20 and downstream side catalyst 23 are the maximum oxygen storage amounts, the upstream side catalyst 20 and downstream side catalyst 23 cannot store the excess oxygen in the exhaust gas. For this reason, if, after fuel cut control, exhaust gas leaner than the stoichiometric air-fuel ratio flows into the upstream side catalyst 20 and downstream side catalyst 23, the $NO_X$ in the exhaust gas is not removed at the upstream side catalyst 20 and downstream side catalyst 23 and the exhaust emissions are liable to deteriorate.

Therefore, in the present embodiment, after fuel cut control, the air-fuel ratio control part 82 performs rich control to make the air-fuel ratio of the air-fuel mixture richer than the stoichiometric air-fuel ratio so that the oxygen storage amount of the upstream side catalyst 20 becomes zero. By doing this, it is possible to decrease the oxygen storage amounts of the upstream side catalyst 20 and downstream side catalyst 23 and possible to keep the exhaust emissions from deteriorating after fuel cut control.

In rich control, the air-fuel ratio control part 82 sets the target air-fuel ratio of the air-fuel mixture to a rich set air-fuel ratio richer than the stoichiometric air-fuel ratio and performs feedback control on the amount of fuel supplied to the combustion chambers 5 so that the air-fuel ratio detected by the upstream side air-fuel ratio sensor 40 matches the target air-fuel ratio. Note that, the air-fuel ratio control part 82 may control the amount of fuel supplied to the combustion chambers 5 so that the air-fuel ratio of the inflowing exhaust gas matches the target air-fuel ratio without using the upstream side air-fuel ratio sensor 40. In this case, the air-fuel ratio control part 82 supplies the combustion chambers 5 with an amount of fuel calculated from the amount of intake air detected by the air flow meter 39 and the target air-fuel ratio of the air-fuel mixture so that the ratio of the fuel and air supplied to the combustion chambers 5 matches the target air-fuel ratio of the air-fuel mixture.

Further, when it is judged that the total of the amounts of intake air from when starting rich control has reached a predetermined amount, the air-fuel ratio control part 82 ends the rich control. The predetermined amount is made larger than the amount required for the oxygen storage amount of the upstream side catalyst 20 to fall from the maximum oxygen storage amount to zero. Note that, the air-fuel ratio control part 82 may end the rich control when the air-fuel ratio detected by the downstream side air-fuel ratio sensor 41 has reached a rich judged air-fuel ratio richer than the stoichiometric air-fuel ratio.

Due to the rich control, the air-fuel ratio of the inflowing exhaust gas changes from an air-fuel ratio leaner than the stoichiometric air-fuel ratio toward the stoichiometric air-fuel ratio. While the oxygen storage amount of the upstream side catalyst 20 is in a suitable range, the air-fuel ratio of the inflowing exhaust gas is maintained at the stoichiometric air-fuel ratio and the output current of the downstream side air-fuel ratio sensor 41 becomes substantially constant. For this reason, the voltage control part 81 corrects the reference value so that the output current of the downstream side air-fuel ratio sensor 41 detected by the current detecting device 61 becomes zero when rich control is performed and the amount of change per predetermined time of the output current of the downstream side air-fuel ratio sensor 41 is equal to or less than a predetermined value.

<Explanation of Control Using Time Chart>

Figure 11:
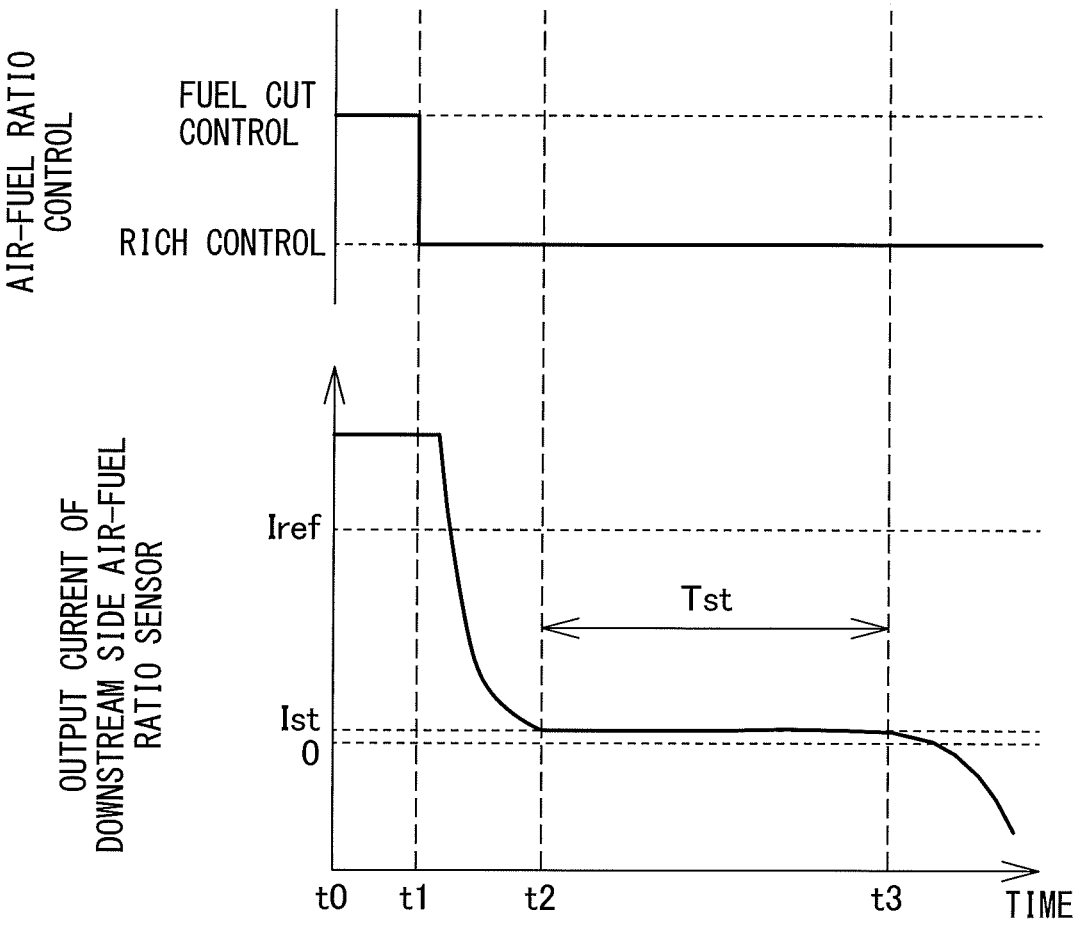
FIG. 11 is a time chart of the type of air-fuel ratio control and the output current of the downstream side air-fuel ratio sensor when rich control is performed after fuel cut control.

FIG. 11 is a time chart of the type of air-fuel ratio control and the output current of the downstream side air-fuel ratio sensor 41 when rich control is performed after fuel cut control. The downstream side air-fuel ratio sensor 41 is supplied with a reference voltage determined so that the output current of the downstream side air-fuel ratio sensor 41 becomes zero when the air-fuel ratio of the inflowing exhaust gas is the stoichiometric air-fuel ratio. In the present embodiment, as will be understood from FIG. 8, the initial value of the reference voltage is 0.45V.

In the example of FIG. 11, at the time to, fuel cut control is performed. At the time t0, due to the fuel cut control, the output current of the downstream side air-fuel ratio sensor 41 becomes an extremely large value. That is, the lean degree of the air-fuel ratio of the inflowing exhaust gas becomes larger.

In the example of FIG. 11, at the time t1, the fuel cut control ends and rich control is started. As a result, after the time t1, the output current of the downstream side air-fuel ratio sensor 41 decreases toward zero. That is, the air-fuel ratio of the inflowing exhaust gas changes toward the stoichiometric air-fuel ratio. After that, at the time t2, the amount of change per predetermined time of the output current of the downstream side air-fuel ratio sensor 41 becomes equal to or less than a predetermined value. As a result, it is judged that the air-fuel ratio of the inflowing exhaust gas at the time t2 to the time t3 is the stoichiometric air-fuel ratio.

The reference voltage is applied to the downstream side air-fuel ratio sensor 41, therefore if there is no deviation in the output current of the downstream side air-fuel ratio sensor 41, the output current Ist of the downstream side air-fuel ratio sensor 41 detected at the time Tst when it is judged that the air-fuel ratio of the inflowing exhaust gas is the stoichiometric air-fuel ratio becomes zero. On the other hand, if deviation in the output current of the downstream side air-fuel ratio sensor 41 occurs, the output current Ist of the downstream side air-fuel ratio sensor 41 becomes a value other than zero.

In the example of FIG. 11, the output current Ist of the downstream side air-fuel ratio sensor 41 is larger than zero. For this reason, the reference voltage is corrected so that the output current Ist of the downstream side air-fuel ratio sensor 41 becomes zero. As will be understood from FIG. 8, by making the reference voltage higher, it is possible to increase the output current of the downstream side air-fuel ratio sensor 41, while by making the reference voltage lower, it is possible to decrease the output current of the downstream side air-fuel ratio sensor 41. For this reason, in the example of FIG. 11, the reference voltage is made lower.

<Processing for Correction of Voltage>

Figure 12:
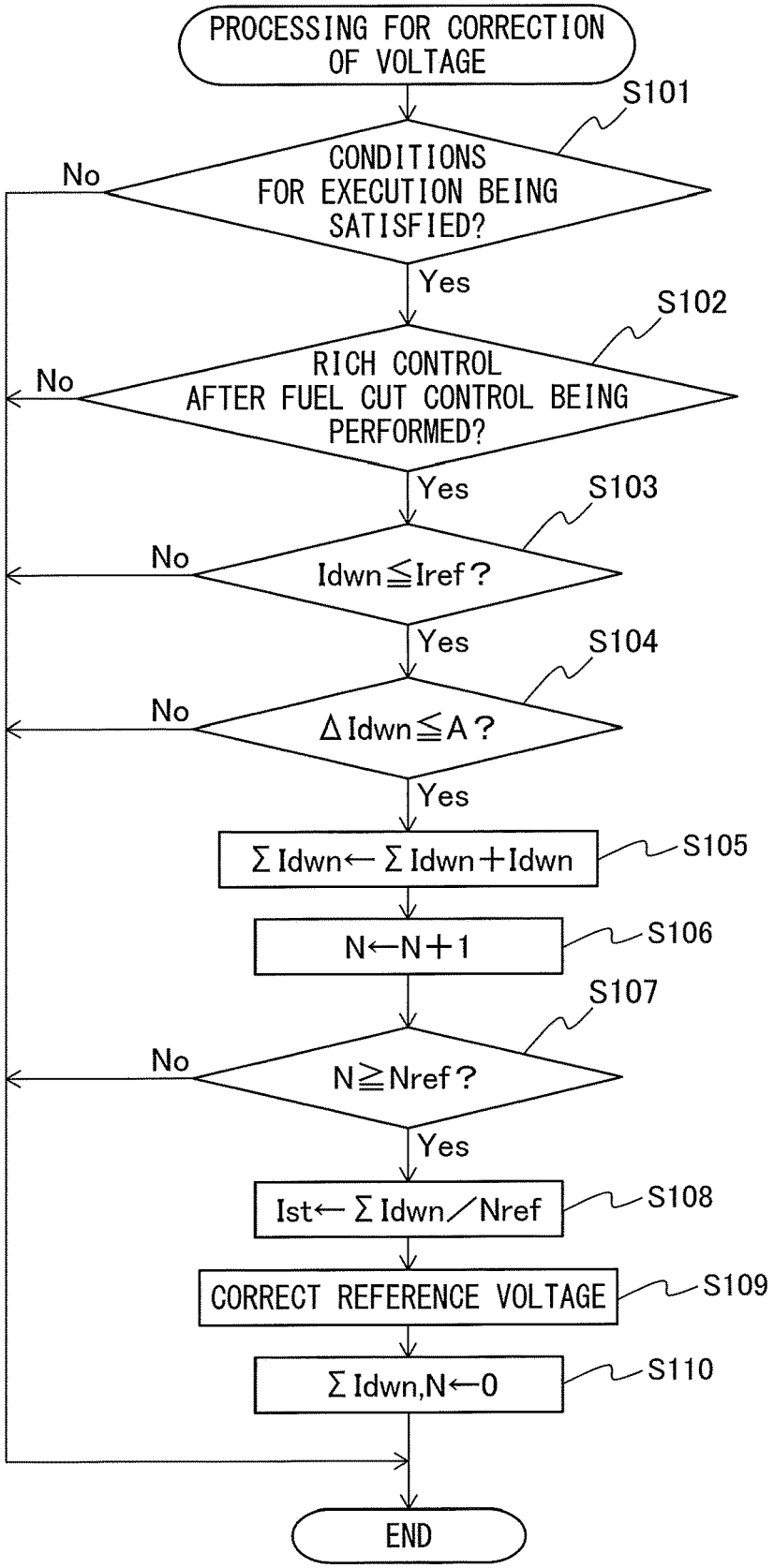
FIG. 12 is a flow chart showing a control routine of processing for correction of voltage in the first embodiment of the present invention.
Figure 13:
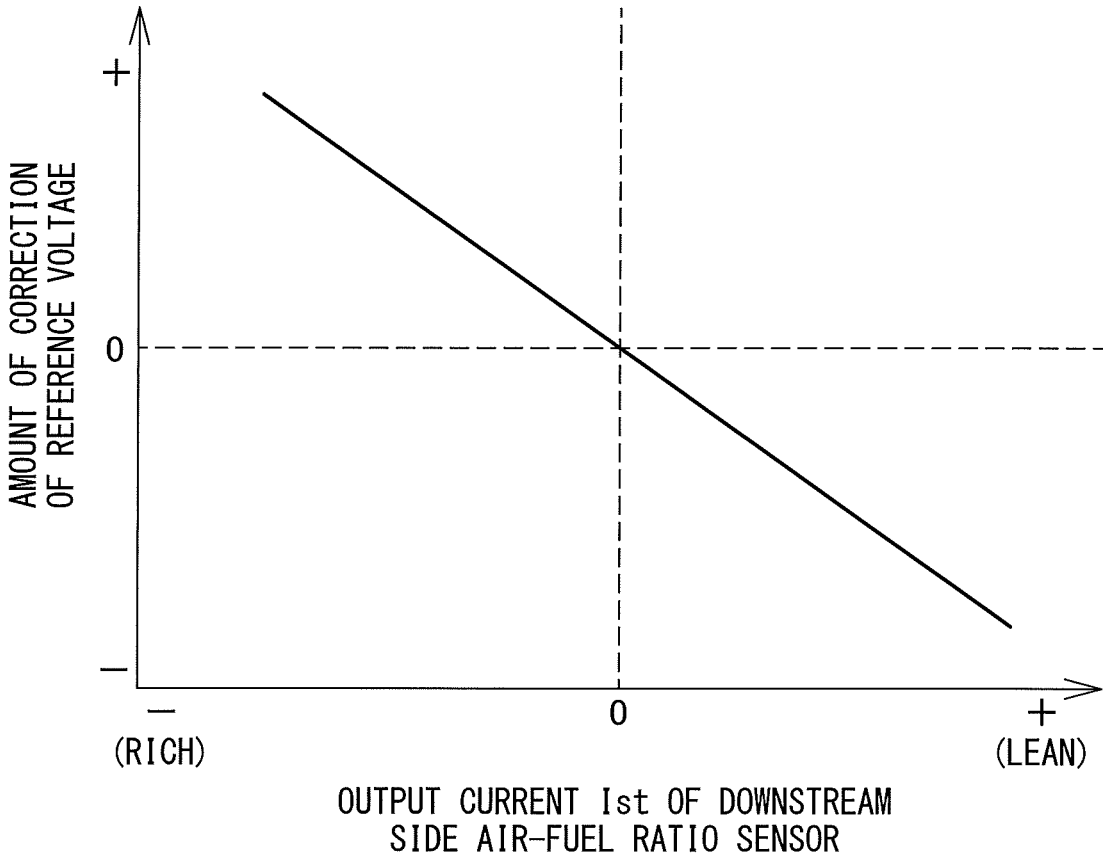
FIG. 13 is a view showing a map for calculating an amount of correction of a reference voltage based on an output current detected when it is judged that an air-fuel ratio of inflowing exhaust gas is a stoichiometric air-fuel ratio.

Below, referring to the flow chart of FIG. 12, control for correcting the reference voltage in the present embodiment will be explained in detail. FIG. 12 is a flow chart showing a control routine of processing for correction of voltage in the first embodiment of the present invention. The present control routine is repeatedly performed after startup of the internal combustion engine by the ECU 31 at predetermined time intervals. In the present control routine, when the output current of the downstream side air-fuel ratio sensor 41 is detected, the applied voltage is set to the reference voltage and the reference voltage is applied to the downstream side air-fuel ratio sensor 41. The initial value of the reference voltage is determined in advance and is set to 0.45V.

First, at step S101, the voltage control part 81 judges whether the conditions for execution for correcting the reference voltage are satisfied. The conditions for execution are satisfied for example, when the temperature of the sensor element of the downstream side air-fuel ratio sensor 41 is equal to or greater than an activation temperature and a predetermined time has elapsed from when the reference voltage was corrected the previous time. The temperature of the sensor element of the downstream side air-fuel ratio sensor 41 is, for example, calculated based on the impedance of the sensor element. If at step S101 it is judged that the conditions for execution are not satisfied, the present control routine ends. On the other hand, if it is judged at step S101 that the conditions for execution are satisfied, the present control routine proceeds to step S102.

At step S102, the voltage control part 81 judges whether rich control is being performed after fuel cut control. If it is judged that rich control is not being performed after fuel cut control, the present control routine ends. On the other hand, if it is judged that rich control is being performed after fuel cut control, the present control routine proceeds to step S103.

At step S103, the voltage control part 81 judges whether the output current Idwn of the downstream side air-fuel ratio sensor 41 is equal to or less than a reference value Iref. The output current Idwn of the downstream side air-fuel ratio sensor 41 is detected by the current detecting device 61. The reference value Iref is determined in advance and, as shown in FIG. 11, is set to a value less than the output current of the downstream side air-fuel ratio sensor 41 detected during fuel cut control. If at step S103 it is judged that the output current Idwn is larger than the reference value Iref, the present control routine ends. On the other hand, if at step S103 it is judged that the output current Idwn is equal to or less than the reference value Iref, the present control routine proceeds to step S104.

At step S104, the voltage control part 81 judges whether the amount of change per predetermined time ΔIdwn of the output current Idwn is equal to or less than a predetermined value A. The predetermined value A is determined in advance and is, for example, set to the maximum value of the amount of change ΔIdwn detected when the air-fuel ratio of the inflowing exhaust gas is maintained at the stoichiometric air-fuel ratio. If at step S104 it is judged that the amount of change ΔIdwn is larger than the predetermined value A, the present control routine ends. On the other hand, if at step S104 it is judged that the amount of change ΔIdwn is equal to or less than the predetermined value A, the present control routine proceeds to step S105. In this case, it is judged that the air-fuel ratio of the inflowing exhaust gas is the stoichiometric air-fuel ratio.

At step S105, the voltage control part 81 updates the sum output current ΣIdwn of the downstream side air-fuel ratio sensor 41. Specifically, the voltage control part 81 sets the value obtained by adding the newly detected output current Idwn to the current sum output current ΣIdwn as the new sum output current ΣIdwn.

Next, at step S106, the voltage control part 81 adds "1" to the number of times of detection N. The initial value of the number of times of detection N is zero.

Next, at step S107, the voltage control part 81 judges whether the number of times of detection N is equal to or greater than a reference number of times Nref. The reference number of times Nref is determined in advance. If at step S107 it is judged that the number of times of detection N is less than the reference number of times Nref, the present control routine ends. On the other hand, if at step S107 it is judged that the number of times of detection N is equal to or greater than the reference number of times Nref, the present control routine proceeds to step S108.

At step S108, the voltage control part 81 calculates the output current Ist of the downstream side air-fuel ratio sensor 41 detected when it is judged that the air-fuel ratio of the inflowing exhaust gas is the stoichiometric air-fuel ratio. The voltage control part 81 calculates the output current Ist by averaging of the plurality of values of the output current Idwn added at step S105. Specifically, the voltage control part 81 divides the sum output current ΣIdwn of the downstream side air-fuel ratio sensor 41 by the reference number of times Nref to thereby calculate the output current Ist. Note that, the value obtained by excluding the maximum value and minimum value from the plurality of values of the output current Idwn may be used to calculate the output current Ist.

Next, at step S109, the voltage control part 81 corrects the reference voltage based on the output current Ist. Specifically, the voltage control part 81 corrects the reference voltage so that the output current Ist becomes zero. For example, the voltage control part 81 uses the map shown in FIG. 13 to calculate the amount of correction of the reference voltage. If the output current Ist is positive, the voltage control part 81 adds a negative amount of correction to the reference voltage and lowers the reference voltage. On the other hand, if the output current Ist is negative, the voltage control part 81 adds a positive amount of correction to the reference voltage and raises the reference voltage. As will be understood from FIG. 13, the corrected reference voltage becomes lower the larger the output current Ist.

Note that, the lower limit value and upper limit value of the reference voltage are determined in advance so that the reference voltage does not become outside the limit current region. In the present embodiment, the upper limit value is set to 0.8V, while the lower limit value is set to 0.1V. That is, the reference voltage is set to 0.45V±0.35V in range. If due to the correction, the reference voltage reaches the upper limit value or lower limit value, the voltage control part 81 suspends the correction of the reference voltage. In this case, the output current Ist may be set to the amount of correction and the air-fuel ratio of the inflowing exhaust gas may be calculated based on the value of the actually detected output current of the downstream side air-fuel ratio sensor 41 minus the output current Ist. That is, the output current of the downstream side air-fuel ratio sensor 41 may be corrected by processing.

By correction of the reference voltage, the value of the reference voltage is updated and the applied voltage is changed to the value of the reference voltage after correction. The timing at which the applied voltage is changed is, for example, when the reference voltage is corrected or when, after the reference voltage is corrected, the internal combustion engine is restarted.

Next, at step S110, the voltage control part 81 resets the sum output current ΣIdwn and number of times of detection N to zero. After step S110, the present control routine ends.

Note that, step S105 and step S106 may be omitted and, at step S108, the voltage control part 81 may acquire the output current Idwn of the downstream side air-fuel ratio sensor 41 detected by the current detecting device 61 as the output current Ist. That is, the output current Ist need not be calculated as the average value of a plurality of values of the output current Idwn.

Further, in the present embodiment, the voltage control part 81 corrects the reference voltage so that the output current Ist becomes zero by a single correction operation. However, the voltage control part 81 may correct the reference voltage so that the output current Ist becomes zero by a plurality of correction operations. In this case, for example, the amount of correction of the reference voltage is calculated based on the value of the output current Ist divided by a predetermined value or value of the amount of correction of the reference voltage calculated based on the output current Ist divided by a predetermined value is set as the final amount of correction. By doing this, if error occurs in the output current Ist, it is possible to keep the precision of detection of the air-fuel ratio by the downstream side air-fuel ratio sensor 41 from deteriorating due to the correction of the reference voltage.

Second Embodiment

The configuration and control of a control system of an internal combustion engine according to a second embodiment are basically the same as the control system of an internal combustion engine according to the first embodiment except for the points explained below. For this reason, below, the second embodiment of the present invention will be explained centered on the parts different from the first embodiment.

In the second embodiment, in order to correct the reference voltage, the air-fuel ratio is controlled differently from the first embodiment so that the air-fuel ratio of the inflowing exhaust gas is rendered the stoichiometric air-fuel ratio. Specifically, the air-fuel ratio control part 82 performs active control switching the air-fuel ratio of the air-fuel mixture between an air-fuel ratio richer than the stoichiometric air-fuel ratio and an air-fuel ratio leaner than the stoichiometric air-fuel ratio so that the oxygen storage amount of the upstream side catalyst 20 changes between zero and the maximum oxygen storage amount.

In active control, the air-fuel ratio control part 82 switches the target air-fuel ratio of the air-fuel mixture from the rich set air-fuel ratio to the lean set air-fuel ratio when the air-fuel ratio detected by the downstream side air-fuel ratio sensor 41 reaches the rich judged air-fuel ratio and switches the target air-fuel ratio of the air-fuel mixture from the lean set air-fuel ratio to the rich set air-fuel ratio when the air-fuel ratio detected by the downstream side air-fuel ratio sensor 41 reaches the lean judged air-fuel ratio.

The rich set air-fuel ratio is determined in advance and is set to an air-fuel ratio richer than the stoichiometric air-fuel ratio. The lean set air-fuel ratio is determined in advance and is set to an air-fuel ratio leaner than the stoichiometric air-fuel ratio. The rich judged air-fuel ratio is determined in advance and is set to an air-fuel ratio richer than the stoichiometric air-fuel ratio and leaner than the rich set air-fuel ratio. For this reason, the oxygen storage amount of the upstream side catalyst 20 when the air-fuel ratio detected by the downstream side air-fuel ratio sensor 41 reaches the rich judged air-fuel ratio becomes zero. The lean judged air-fuel ratio is determined in advance and is set to an air-fuel ratio leaner than the stoichiometric air-fuel ratio and richer than the lean set air-fuel ratio. For this reason, the oxygen storage amount of the upstream side catalyst 20 when the air-fuel ratio detected by the downstream side air-fuel ratio sensor 41 reaches the lean judged air-fuel ratio becomes the maximum oxygen storage amount.

Further, the air-fuel ratio control part 82 performs feedback control of the amount of fuel supplied to the combustion chambers 5 so that the air-fuel ratio detected by the upstream side air-fuel ratio sensor 40 in active control matches the target air-fuel ratio of the air-fuel mixture. Note that, the air-fuel ratio control part 82 may control the amount of fuel supplied to the combustion chambers 5 so that the air-fuel ratio of the inflowing exhaust gas matches the target air-fuel ratio of the air-fuel mixture without using the upstream side air-fuel ratio sensor 40. In this case, the air-fuel ratio control part 82 supplies the combustion chambers 5 with the amount of fuel calculated from the amount of intake air detected by the air flow meter 39 and the target air-fuel ratio of the air-fuel mixture so that the ratio of the fuel and air supplied to the combustion chambers 5 matches the target air-fuel ratio of the air-fuel mixture.

By switching the target air-fuel ratio from the rich set air-fuel ratio to the lean set air-fuel ratio, the air-fuel ratio of the inflowing exhaust gas changes from an air-fuel ratio richer than the stoichiometric air-fuel ratio toward the stoichiometric air-fuel ratio. On the other hand, by switching the target air-fuel ratio from the lean set air-fuel ratio to the rich set air-fuel ratio, the air-fuel ratio of the inflowing exhaust gas changes from an air-fuel ratio leaner than the stoichiometric air-fuel ratio toward the stoichiometric air-fuel ratio. While the oxygen storage amount of the upstream side catalyst 20 is in a suitable range, the air-fuel ratio of the inflowing exhaust gas is maintained at the stoichiometric air-fuel ratio and the output current of the downstream side air-fuel ratio sensor 41 becomes substantially constant. For this reason, the voltage control part 81 corrects the reference voltage so that the output current of the downstream side air-fuel ratio sensor 41 detected by the current detecting device 61 becomes zero when active control is performed and the amount of change per predetermined time of the output current of the downstream side air-fuel ratio sensor 41 is equal to or less than a predetermined value.

<Explanation of Control Using Time Chart>

Figure 14:
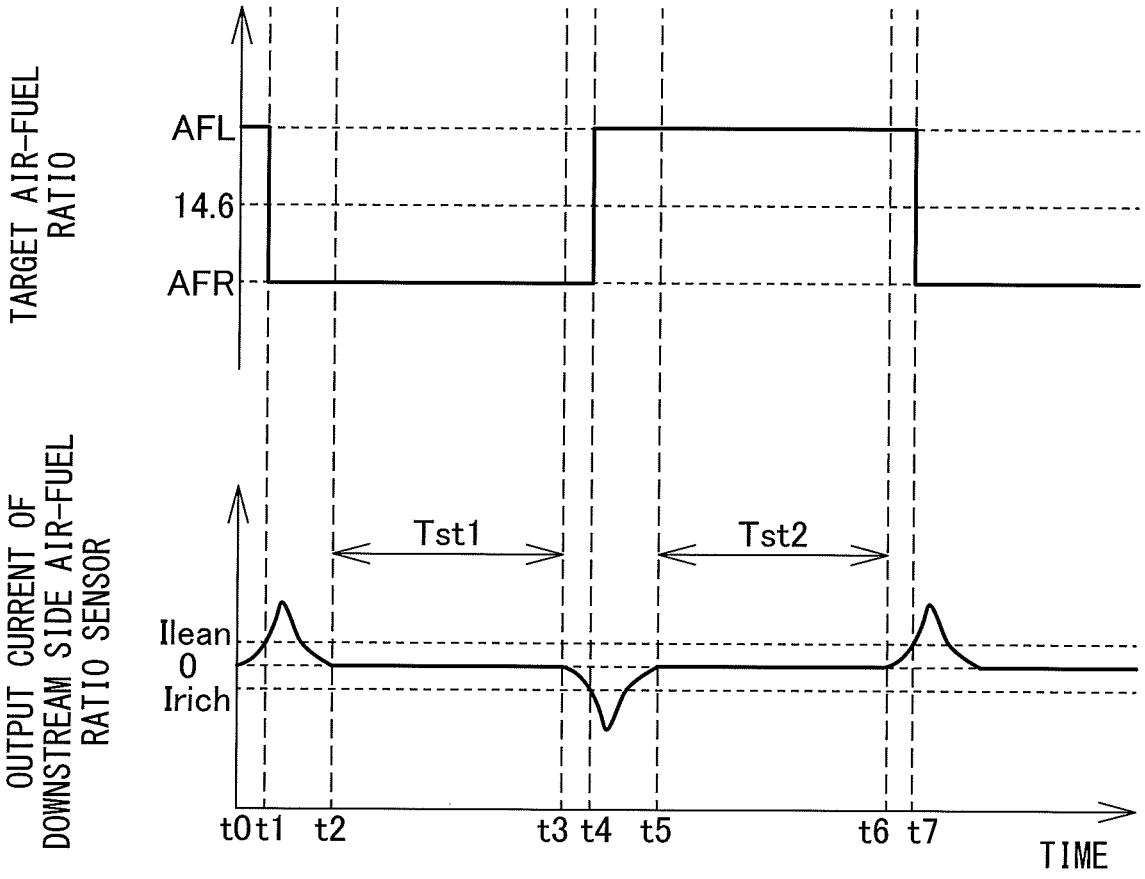
FIG. 14 is a time chart of a target air-fuel ratio of an air-fuel mixture and the output current of the downstream side air-fuel ratio sensor when active control is performed.

FIG. 14 is a time chart of the target air-fuel ratio of the air-fuel mixture and the output current of the downstream side air-fuel ratio sensor 41 when active control is performed. The downstream side air-fuel ratio sensor 41 is supplied with a reference voltage. The initial value of the reference voltage is 0.45V.

At the time to, the target air-fuel ratio is set to the lean set air-fuel ratio AFL. The lean set air-fuel ratio AFL is, for example, set to 15.1. After the time to, at the time t1, the output current of the downstream side air-fuel ratio sensor 41 reaches the lean judged current Ilean. The lean judged current Ilean is the output current corresponding to the lean judged air-fuel ratio (for example, 14.65).

At the time t1, the air-fuel ratio detected by the downstream side air-fuel ratio sensor 41 reaches the lean judged air-fuel ratio, therefore the target air-fuel ratio is switched from the lean set air-fuel ratio AFL to the rich set air-fuel ratio AFR. The rich set air-fuel ratio AFR is, for example, set to 14.1.

Due to the switching of the target air-fuel ratio, the output current of the downstream side air-fuel ratio sensor 41 decreases toward zero. That is, the air-fuel ratio of the inflowing exhaust gas changes toward the stoichiometric air-fuel ratio. After that, at the time t2, the amount of change per predetermined time of the output current of the downstream side air-fuel ratio sensor 41 becomes equal to or less than a predetermined value. As a result, at the time t2 to the time t3, it is judged that the air-fuel ratio of the inflowing exhaust gas is the stoichiometric air-fuel ratio.

In the example of FIG. 14, the output current of the downstream side air-fuel ratio sensor 41 detected at the time Tst1 at which it is judged that the air-fuel ratio of the inflowing exhaust gas is the stoichiometric air-fuel ratio when the target air-fuel ratio is set to the rich set air-fuel ratio AFR is zero. In this case, since there is no deviation in the output current of the downstream side air-fuel ratio sensor 41, the reference voltage is not corrected.

After the time t3, at the time t4, the output current of the downstream side air-fuel ratio sensor 41 reaches the rich judged current Irich. The rich judged current Irich is the output current corresponding to the rich judged air-fuel ratio (for example, 14.55).

At the time t4, the air-fuel ratio detected by the downstream side air-fuel ratio sensor 41 has reached the rich judged air-fuel ratio, therefore the target air-fuel ratio is switched from the rich set air-fuel ratio AFL to the lean set air-fuel ratio AFL.

By switching the target air-fuel ratio, the output current of the downstream side air-fuel ratio sensor 41 increases toward zero. That is, the air-fuel ratio of the inflowing exhaust gas changes toward the stoichiometric air-fuel ratio. After that, at the time t5, the amount of change per predetermined time of the output current of the downstream side air-fuel ratio sensor 41 becomes equal to or less than a predetermined value. As a result, at the time t5 to the time t6, it is judged that the air-fuel ratio of the inflowing exhaust gas is the stoichiometric air-fuel ratio.

In the example of FIG. 14, the output current of the downstream side air-fuel ratio sensor 41 detected at the time Tst2 at which it is judged that the air-fuel ratio of the inflowing exhaust gas is the stoichiometric air-fuel ratio when the target air-fuel ratio is set to the lean set air-fuel ratio AFL is zero. In this case, there is no deviation in the output current of the downstream side air-fuel ratio sensor 41, therefore the reference voltage is not corrected.

After the time t6, at the time t7, the output current of the downstream side air-fuel ratio sensor 41 again reaches the lean judged current Ilean and the target air-fuel ratio is switched from the lean set air-fuel ratio AFL to the rich set air-fuel ratio AFR.

<Processing for Correction of Voltage>

Figure 15:
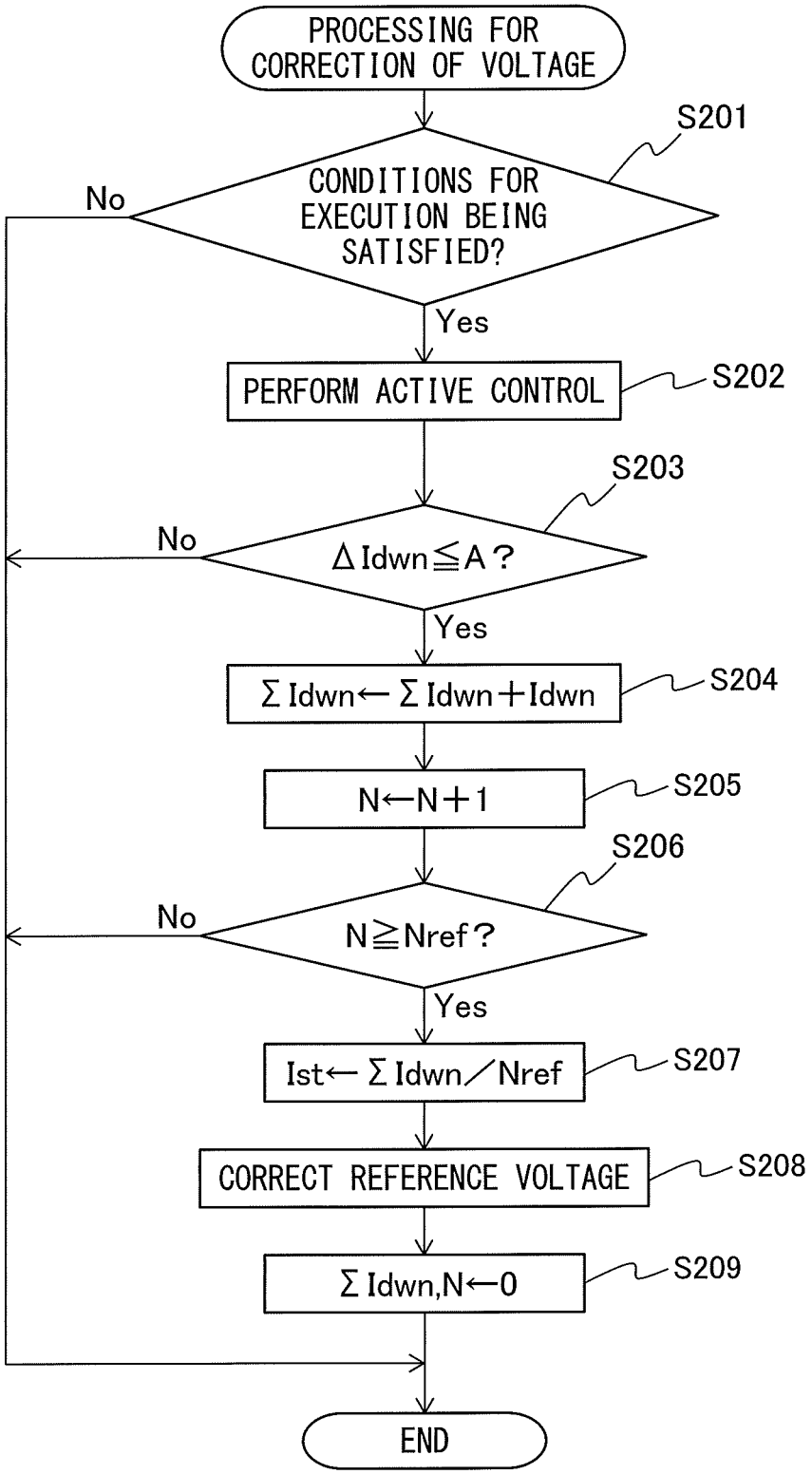
FIG. 15 is a flow chart showing a control routine of processing for correction of voltage in a second embodiment of the present invention.

FIG. 15 is a flow chart showing a control routine of processing for correction of voltage in the second embodiment of the present invention. The present control routine is repeatedly performed after startup of the internal combustion engine by the ECU 31 at predetermined time intervals. In the present control routine, when the output current of the downstream side air-fuel ratio sensor 41 is detected, the applied voltage is set to the reference voltage and the reference voltage is applied to the downstream side air-fuel ratio sensor 41. The initial value of the reference voltage is determined in advance and is set to 0.45V.

First, at step S201, in the same way as step S101 of FIG. 12, the voltage control part 81 judges whether conditions for execution of correction of the reference voltage are satisfied. If at step S101 it is judged that the conditions for execution are not satisfied, the present control routine ends. On the other hand, if at step S101 it is judged that the conditions for execution are satisfied, the present control routine proceeds to step S102.

At step S202, the air-fuel ratio control part 82 performs active control. Next, at step S203, in the same way as step S104 of FIG. 12, the voltage control part 81 judges whether the amount of change per predetermined time ΔIdwn of the output current Idwn is equal to or less than a predetermined value A. If at step S203 it is judged that the amount of change ΔIdwn is greater than the predetermined value A, the present control routine ends. On the other hand, if at step S203 it is judged that the amount of change ΔIdwn is equal to or less than the predetermined value A, the present control routine proceeds to step S204.

Step S204 to step S209 are similar to step S105 to step S110 of FIG. 12, therefore explanations will be omitted. Note that, the present control routine can be modified in the same way as the control routine of FIG. 12.

<Third Embodiment>

The configuration and control of a control system of an internal combustion engine according to a third embodiment are basically the same as the control system of an internal combustion engine according to the first embodiment except for the points explained below. For this reason, below, the third embodiment of the present invention will be explained centered on the parts different from the first embodiment.

In the third embodiment, the voltage control part 81 switches the applied voltage between a reference voltage and a switching voltage different from the reference voltage. In order to use the downstream side air-fuel ratio sensor 41 to precisely detect a predetermined air-fuel ratio, it is desirable to make the output current of the downstream side air-fuel ratio sensor 41 corresponding to the predetermined air-fuel ratio approach zero.

As will be understood from FIG. 8, by raising the applied voltage, it is possible to shift the air-fuel ratio corresponding to zero output current to the rich side. On the other hand, by lowering the applied voltage, it is possible to shift the air-fuel ratio corresponding to zero output current to the lean side. For this reason, for example, the voltage control part 81 sets the applied voltage to a first switching voltage when the target air-fuel ratio of the air-fuel mixture is an air-fuel ratio richer than the stoichiometric air-fuel ratio, sets the applied voltage to the reference voltage when the target air-fuel ratio of the air-fuel mixture is the stoichiometric air-fuel ratio, and sets the applied voltage to a second switching voltage when the target air-fuel ratio of the air-fuel mixture is an air-fuel ratio leaner than the stoichiometric air-fuel ratio. The first switching voltage is higher than the reference voltage, while the second switching voltage is lower than the reference voltage. Note that, there may be other than two switching voltages.

If correcting the reference voltage to correct deviation of the output of the downstream side air-fuel ratio sensor 41, the switching voltage also has to be corrected. However, if the amount of correction of the reference voltage is also added to the switching voltage to correct the switching voltage, the correspondence relationship between the air-fuel ratio corresponding to the reference voltage when the output current is zero and the air-fuel ratio corresponding to the switching voltage when the output current is zero is liable to change due to the correction.

Figure 16:
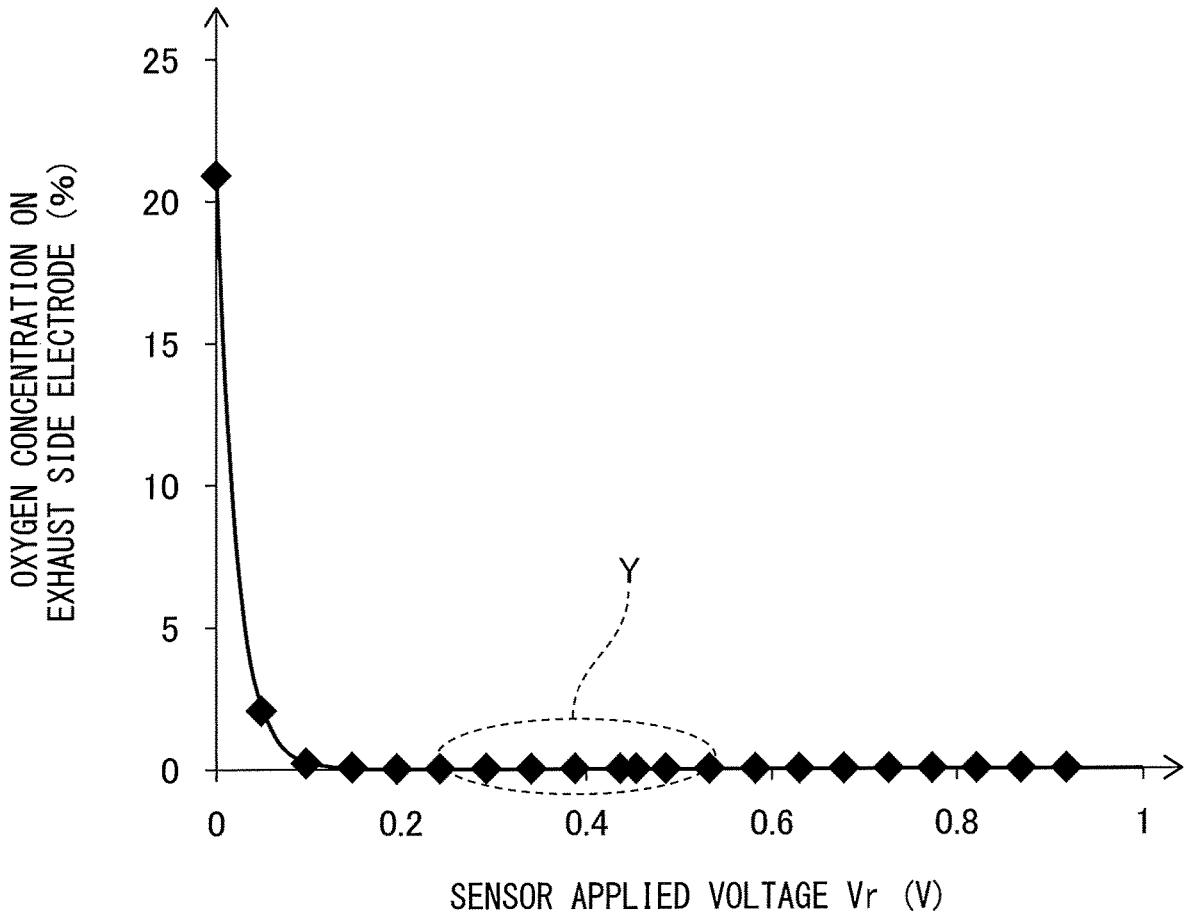
FIG. 16 is a graph showing a relationship between a sensor applied voltage and an oxygen concentration on an exhaust side electrode when the output current is zero.
Figure 17:
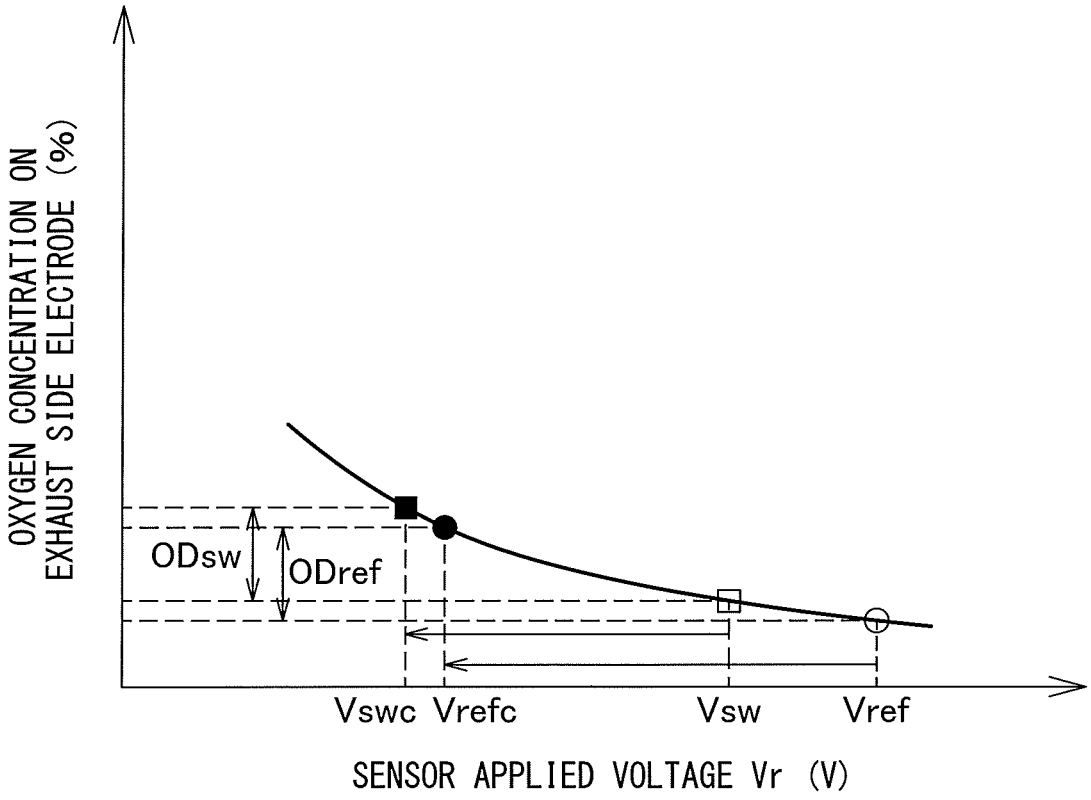
FIG. 17 is a schematic enlarged view of a Y region of FIG. 16.

FIG. 16 is a graph showing the relationship between the sensor applied voltage Vr and the oxygen concentration on the exhaust side electrode (below, simply referred to as the "oxygen concentration") when the output current is zero. FIG. 16 is a view similar to FIG. 9, but in FIG. 16, the y-axis (oxygen concentration on exhaust side electrode) is not shown by a logarithmic scale. FIG. 17 is a schematic enlarged view of the Y region of FIG. 16.

FIG. 17 shows the oxygen concentration corresponding to the reference voltage Vref before correction when the output current is zero by a white circle and shows the oxygen concentration corresponding to the corrected reference voltage Vrefc when the output current is zero by a black circle. In this example, due to the correction, the reference voltage is made lower.

Further, FIG. 17 shows the oxygen concentration corresponding to the switching voltage Vsw before correction when the output current is zero by a white square and shows the oxygen concentration corresponding to the corrected switching voltage Vswc when the output current is zero by a black square.

When correcting the reference voltage, the voltage control part 81 corrects the switching voltage so that the difference between the oxygen concentration corresponding to the reference voltage when the output current is zero and the oxygen concentration corresponding to the switching voltage when the output current is zero becomes constant. By doing this, it is possible to keep the correspondence relationship between the air-fuel ratio detected precisely at the reference voltage (stoichiometric air-fuel ratio) and the air-fuel ratio detected precisely at the switching voltage from changing due to the correction.

FIG. 17 shows the difference ODref between the oxygen concentration corresponding to the reference voltage Vref before correction when the output current is zero and the oxygen concentration corresponding to the reference voltage Vrefc after correction when the output current is zero and the difference ODsw between the oxygen concentration corresponding to the switching voltage Vsw before correction when the output current is zero and the oxygen concentration corresponding to the switching voltage Vswc after correction when the output current is zero. By correcting the switching voltage in this way, the difference ODsw becomes equal to the difference ODref.

<Processing for Correction of Voltage>

Figure 18:
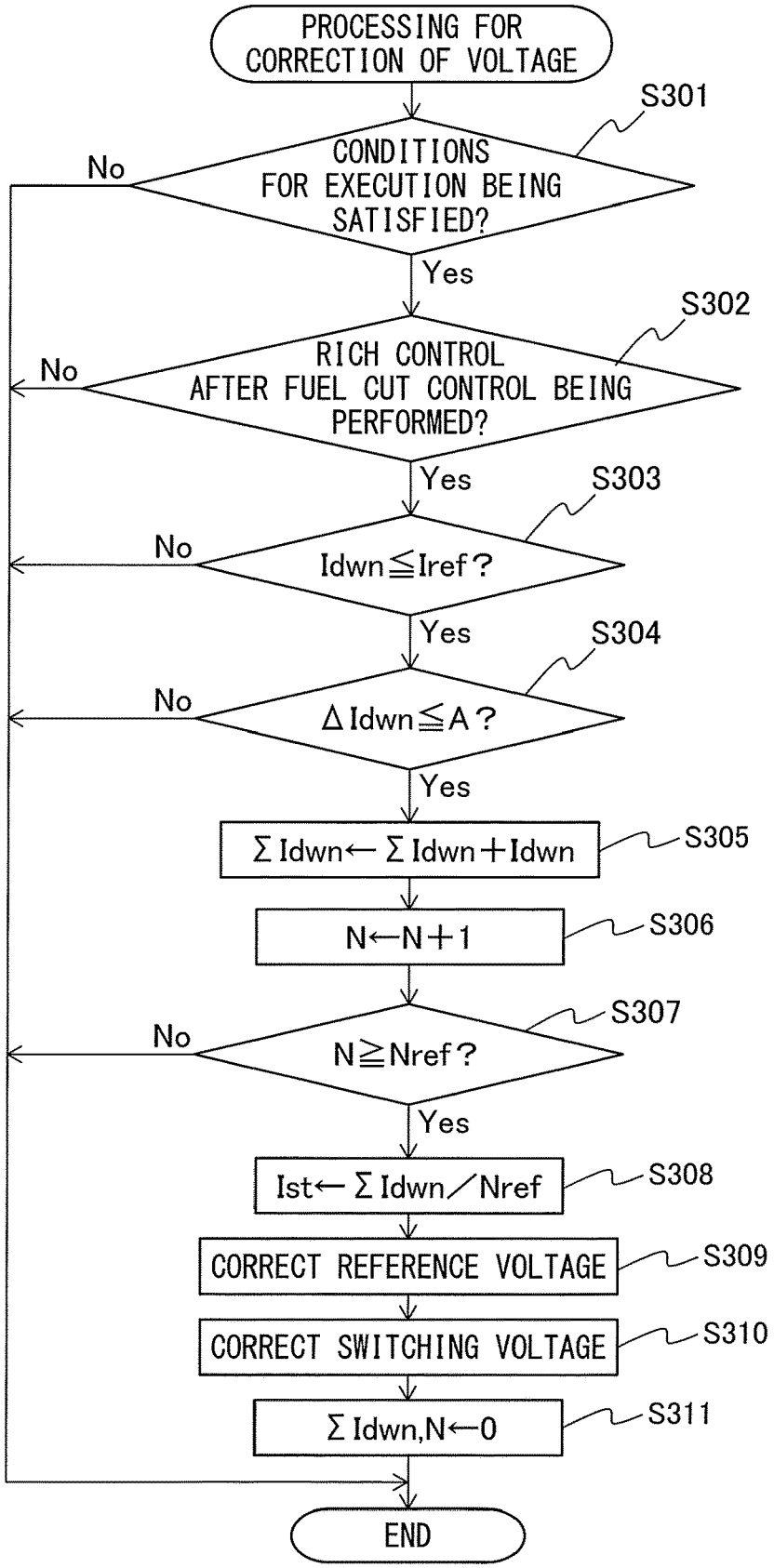
FIG. 18 is a flow chart showing a control routine of processing for correction of voltage in a third embodiment of the present invention.

FIG. 18 is a flow chart showing a control routine of processing for correction of voltage in the third embodiment of the present invention. The present control routine is repeatedly performed after startup of the internal combustion engine by the ECU 31 at predetermined time intervals. In the present control routine, when the output current of the downstream side air-fuel ratio sensor 41 is detected, the applied voltage is set to the reference voltage and the reference voltage is applied to the downstream side air-fuel ratio sensor 41. The initial value of the reference voltage is determined in advance and is set to 0.45V.

Step S301 to step S309 are similar to step S101 to step S109 of FIG. 12, therefore explanations will be omitted.

In the present control routine, after step S309, at step S310, the voltage control part 81 corrects the switching voltage so that the difference between the oxygen concentration corresponding to the reference voltage when the output current is zero and the oxygen concentration corresponding to the switching voltage when the output current is zero becomes constant.

Specifically, the voltage control part 81 uses a map or calculation formula to calculate an oxygen concentration corresponding to the corrected reference voltage when the output current is zero. Next, the voltage control part 81 adds the initial concentration difference to the oxygen concentration corresponding to the corrected reference voltage when the output current is zero to thereby calculate the target oxygen concentration. The initial concentration difference is the difference between the oxygen concentration corresponding to the initial value of the reference voltage when the output current is zero and the oxygen concentration corresponding to the initial value of the switching voltage when the output current is zero and is determined in advance by experiments, simulation, etc. Finally, the voltage control part 81 uses a map or calculation formula to calculate the applied voltage where the oxygen concentration becomes the target oxygen concentration when the output current is zero as the corrected switching voltage.

Next, at step S311, the voltage control part 81 resets the sum output current ΣIdwn and number of times of detection N to zero. After step S311, the present control routine ends. Note that, the present control routine can be modified in the same way as the control routine of FIG. 12.

Above, preferred embodiments according to the present invention were explained, but the present invention is not limited to these embodiments. Various corrections and changes can be made within the language of the claims.

Regardless of the type of the air-fuel ratio control, when the output current of the downstream side air-fuel ratio sensor 41 is within a predetermined range and the amount of change per predetermined time of the output current of the downstream side air-fuel ratio sensor 41 is equal to or less than a predetermined value, there is a high possibility of the air-fuel ratio of the inflowing exhaust gas becoming the stoichiometric air-fuel ratio due to the purification of the exhaust gas by the upstream side catalyst 20. For this reason, the voltage control part 81 may correct the reference voltage so that the output current of the downstream side air-fuel ratio sensor 41 detected by the current detecting device 61 becomes zero when the output current of the downstream side air-fuel ratio sensor 41 is within a predetermined range and the amount of change per predetermined time of the output current of the downstream side air-fuel ratio sensor 41 is equal to or less than a predetermined value. In this case, it is not necessarily required that the air-fuel ratio control part 82 perform the predetermined air-fuel ratio control so as to correct the reference voltage.

Further, the downstream side air-fuel ratio sensor 41 may be arranged at the downstream side of the downstream side catalyst 23. Further, the control system of the internal combustion engine may be provided with an upstream side air-fuel ratio sensor 40 in addition to the downstream side air-fuel ratio sensor 41 or instead of the downstream side air-fuel ratio sensor 41. That is, in the same way as the downstream side air-fuel ratio sensor 41, the reference voltage and the switching voltage applied to the upstream side air-fuel ratio sensor 40 may be corrected. In this case, for example, the air-fuel ratio control part 82 sets the target air-fuel ratio of the air-fuel mixture to the stoichiometric air-fuel ratio, and the voltage control part 81 corrects the reference voltage so that the output current of the upstream side air-fuel ratio sensor 40 detected when the amount of change per predetermined time of the output current of the upstream side air-fuel ratio sensor 40 is equal to or less than a predetermined value becomes zero.

REFERENCE SIGNS LIST

20. upstream side catalyst
22. exhaust pipe
31. electronic control unit (ECU)
40. upstream side air-fuel ratio sensor
41. downstream side air-fuel ratio sensor
60. voltage applying device
61. current detecting device
81. voltage control part
82. air-fuel ratio control part

The invention claimed is:

1. A control system of an internal combustion engine comprising:

an air-fuel ratio sensor arranged in an exhaust passage of the internal combustion engine and detecting an air-fuel ratio of exhaust gas, a current detecting device detecting an output current of the air-fuel ratio sensor, a voltage applying device applying voltage to the air-fuel ratio sensor, and a voltage control part configured to control voltage applied to the air-fuel ratio sensor through the voltage applying device, wherein the voltage control part is configured to set the applied voltage to a reference voltage determined so that the output current becomes zero when an air-fuel ratio of inflowing exhaust gas flowing into the air-fuel ratio sensor is a stoichiometric air-fuel ratio, and correct the reference voltage so that the output current detected by the current detecting device becomes zero when it is judged that the air-fuel ratio of the inflowing exhaust gas is the stoichiometric air-fuel ratio.

2. The control system of an internal combustion engine according to claim 1, wherein a catalyst able to store oxygen is arranged in the exhaust passage, and the air-fuel ratio sensor is arranged at a downstream side of the catalyst.

3. The control system of an internal combustion engine according to claim 2, further comprising an air-fuel ratio control part configured to control an air-fuel ratio of an air-fuel mixture supplied to combustion chambers of the internal combustion engine, wherein the air-fuel ratio control part is configured to control the air-fuel ratio of the air-fuel mixture so that an oxygen storage amount of the catalyst changes between zero and a maximum oxygen storage amount, and the voltage control part is configured to correct the reference voltage so that the output current detected by the current detecting device becomes zero when an amount of change per predetermined time of the output current is equal to or less than a predetermined value.

4. The control system of an internal combustion engine according to claim 3, wherein the air-fuel ratio control part is configured to perform fuel cut control stopping supply of fuel to the combustion chambers and after the fuel cut control perform rich control making the air-fuel ratio of the air-fuel mixture an air-fuel ratio richer than a stoichiometric air-fuel ratio so that the oxygen storage amount of the catalyst becomes zero, and the voltage control part is configured to correct the reference voltage so that the output current detected by the current detecting device becomes zero when the rich control is performed and the amount of change per predetermined time of the output current is equal to or less than the predetermined value.

5. The control system of an internal combustion engine according to claim 3, wherein the air-fuel ratio control part is configured to perform active control switching the air-fuel ratio of the air-fuel mixture between an air-fuel ratio richer than the stoichiometric air-fuel ratio and an air-fuel ratio leaner than the stoichiometric air-fuel ratio so that the oxygen storage amount of the catalyst changes between zero and the maximum oxygen storage amount, and the voltage control part is configured to correct the reference voltage so that the output current detected by the current detecting device becomes zero when the active control is performed and the amount of change per predetermined time of the output current is equal to or less than the predetermined value.

6. The control system of an internal combustion engine according to claim 1, wherein the voltage control part is configured to switch the applied voltage between the reference voltage and a switching voltage different from the reference voltage and, when correcting the reference voltage, correct the switching voltage so that a difference between an oxygen concentration on an exhaust side electrode of the air-fuel ratio sensor corresponding to the reference voltage when the output current is zero and the oxygen concentration on the exhaust side electrode of the air-fuel ratio sensor corresponding to the switching voltage when the output current is zero becomes constant.

7. A control system of an internal combustion engine comprising:

an air-fuel ratio sensor arranged in an exhaust passage of the internal combustion engine and detecting an air-fuel ratio of exhaust gas, a current detecting device detecting an output current of the air-fuel ratio sensor, a voltage applying device applying voltage to the air-fuel ratio sensor, and an electronic control unit, wherein the electronic control unit is configured to control voltage applied to the air-fuel ratio sensor through the voltage applying device, set the applied voltage to a reference voltage determined so that the output current becomes zero when an air-fuel ratio of inflowing exhaust gas flowing into the air-fuel ratio sensor is a stoichiometric air-fuel ratio, and correct the reference voltage so that the output current detected by the current detecting device becomes zero when it is judged that the air-fuel ratio of the inflowing exhaust gas is the stoichiometric air-fuel ratio.

* * * * *